US012484671B2

(12) United States Patent
Tran et al.

(10) Patent No.: US 12,484,671 B2
(45) **Date of Patent: *Dec. 2, 2025**

(54) MONEY CLIP

(71) Applicant: CTB HOLDINGS LLC, Portola Valley, CA (US)

(72) Inventors: Thuan Tran, San Jose, CA (US); Charlie Carroll, Palo Alto, CA (US); Binh Tran, Santa Clara, CA (US)

(73) Assignee: CTB HOLDINGS LLC, Portola Valley, CA (US)

( * ) Notice: Subject to any disclaimer, the term of this patent is extended or adjusted under 35 U.S.C. 154(b) by 368 days.

This patent is subject to a terminal disclaimer.

(21) Appl. No.: 17/897,090

(22) Filed: Aug. 26, 2022

(65) Prior Publication Data

US 2023/0096354 A1 Mar. 30, 2023

Related U.S. Application Data

(63) Continuation-in-part of application No. 17/489,015, filed on Sep. 29, 2021, now Pat. No. 11,425,976.

(51) Int. Cl.
*A45C 1/06* (2006.01)

(52) U.S. Cl.
CPC ..... *A45C 1/06* (2013.01); *A45C 2001/062* (2013.01)

(58) Field of Classification Search
CPC ..... A45C 1/06; A45C 2001/062
USPC ..... 150/132
See application file for complete search history.

(56) References Cited

U.S. PATENT DOCUMENTS

| | | | |
|---|---|---|---|
| 1,415,276 | A | 5/1922 | Edward |
| 1,463,619 | A | 7/1923 | Gardner |
| 1,585,051 | A | 5/1926 | Skoglund |
| 1,832,625 | A | 11/1931 | Gardner |
| D187,240 | S | 2/1960 | Harkins |

(Continued)

FOREIGN PATENT DOCUMENTS

| | | |
|---|---|---|
| CA | 2471793 | 6/2003 |
| CN | 305992507 | 8/2020 |

(Continued)

OTHER PUBLICATIONS

Dango Products—"Wallet Collections"—Available from Internet <URL: www.dangoproducts.com/collections/wallets>—Available at least as of Oct. 19, 2017—Retrieved from Internet Archive Wayback Machine <URL: https://web.archive.org/web/20171019082039/www.dangoproducts.com/collections/wallets> on Oct. 23, 2020.

(Continued)

*Primary Examiner* — Sue A Weaver
(74) *Attorney, Agent, or Firm* — Gallium Law; Jacob Panangat; Michael Bakke

(57) ABSTRACT

The disclosure includes a money clip comprising a chassis defining a first side and a second side located opposite the first side, a first coupling element coupled to the chassis, and a second coupling element coupled to the chassis. In some embodiments, the first coupling element is configured to retain a personal effect between the first coupling element and the first side of the chassis, and the second coupling element is configured to retain a personal effect between the second coupling element and the second side of the chassis. The first coupling element may be configured to overlap the second coupling element.

20 Claims, 18 Drawing Sheets

(56) References Cited

U.S. PATENT DOCUMENTS

| | | | |
|---|---|---|---|
| 3,461,469 | A | 8/1969 | Morrision |
| D256,852 | S | 9/1980 | McGahee |
| 4,305,497 | A | 12/1981 | Pacilio |
| D266,479 | S | 10/1982 | Hayakawa |
| 4,691,456 | A | 9/1987 | Ackeret |
| 4,705,086 | A | 11/1987 | O'Neill |
| 4,763,821 | A | 8/1988 | Powell |
| 4,774,779 | A | 10/1988 | Ackeret |
| 4,932,520 | A | 6/1990 | Ciarcia |
| D314,865 | S | 2/1991 | Tuisku |
| 5,038,926 | A | 8/1991 | van der Toorn |
| D322,039 | S | 12/1991 | Chien |
| 5,077,869 | A | 1/1992 | Haase |
| D337,656 | S | 7/1993 | Hostert |
| 5,234,351 | A | 8/1993 | Dixon |
| 5,279,019 | A | 1/1994 | Knickle |
| 5,328,026 | A | 7/1994 | Newman |
| D360,815 | S | 8/1995 | Padden |
| D366,146 | S | 1/1996 | Bertrand |
| D374,388 | S | 10/1996 | Padden |
| 5,573,164 | A | 11/1996 | Law |
| 5,592,767 | A | 1/1997 | Treske |
| D384,499 | S | 10/1997 | Gaestel |
| 5,740,624 | A | 4/1998 | Baseley |
| D398,446 | S | 9/1998 | Hosea |
| D404,567 | S | 1/1999 | Akutsu |
| 5,901,764 | A | 5/1999 | Ritter |
| 5,929,427 | A | 7/1999 | Harada |
| 5,944,080 | A | 8/1999 | Podwika |
| D416,581 | S | 11/1999 | Cheng |
| 6,009,584 | A | 1/2000 | Padden |
| 6,044,967 | A | 4/2000 | Painsith |
| 6,076,665 | A | 6/2000 | Chuang |
| 6,089,289 | A | 7/2000 | Florjancic |
| D431,105 | S | 9/2000 | Ling |
| 6,145,994 | A | 11/2000 | Ng |
| D434,624 | S | 12/2000 | Padden |
| D444,060 | S | 6/2001 | Elsener |
| 6,276,414 | B1 | 8/2001 | Bibb |
| D447,438 | S | 9/2001 | Dilibero |
| 6,347,875 | B1 | 2/2002 | Painsith |
| D462,000 | S | 8/2002 | Hightower |
| 6,427,837 | B1 | 8/2002 | Shields |
| 6,460,698 | B1 | 10/2002 | Wang |
| 6,823,910 | B1 | 11/2004 | Elnekaveh |
| 6,851,147 | B2 | 2/2005 | Abrahall |
| D517,390 | S | 3/2006 | Cheng |
| D525,162 | S | 7/2006 | Suman |
| 7,334,616 | B2 | 2/2008 | Kaminski |
| 7,546,860 | B1 | 6/2009 | Mehdizadeh |
| 7,556,073 | B2 | 7/2009 | Lyons |
| 7,568,250 | B2 | 8/2009 | Menard-Flanagan |
| 7,604,028 | B2 | 10/2009 | Bridgefarmer |
| 7,617,928 | B1 | 11/2009 | Murphy |
| D632,695 | S | 2/2011 | Berntsen |
| 7,918,335 | B1 | 4/2011 | Kitchen |
| 7,921,890 | B2 | 4/2011 | Ho |
| 7,971,324 | B2 | 7/2011 | Preston-Hall |
| 8,047,363 | B2 | 11/2011 | Sheba |
| 8,251,210 | B2 | 8/2012 | Schmidt |
| D685,990 | S | 7/2013 | Zhang |
| D690,931 | S | 10/2013 | Minn |
| 8,567,459 | B2 | 10/2013 | Kitchen |
| D695,013 | S | 12/2013 | Minn |
| D701,043 | S | 3/2014 | Minn |
| 8,726,952 | B2 | 5/2014 | Jambunathan |
| D706,271 | S | 6/2014 | Gelsomini |
| D707,091 | S | 6/2014 | Barr |
| 8,763,795 | B1 | 7/2014 | Oten |
| 8,776,846 | B1 | 7/2014 | Thompson |
| D716,043 | S | 10/2014 | Wilk |
| 8,863,793 | B2 | 10/2014 | Black |
| D718,525 | S | 12/2014 | Kim |
| D719,350 | S | 12/2014 | Daoura |
| 8,899,411 | B2 | 12/2014 | Van Geer |
| 9,125,464 | B2 | 9/2015 | Minn |
| 9,125,465 | B2 | 9/2015 | Beckley |
| D743,760 | S | 11/2015 | Barr |
| D745,274 | S | 12/2015 | Minn |
| D750,888 | S | 3/2016 | Johnson |
| D751,877 | S | 3/2016 | Shlaferman |
| 9,314,074 | B2 * | 4/2016 | Johnson ..... A45C 1/06 |
| D755,764 | S | 5/2016 | Dong |
| 9,339,094 | B2 | 5/2016 | Tucker-Skow |
| D765,487 | S | 9/2016 | Barr |
| D768,382 | S | 10/2016 | Wu |
| D768,383 | S | 10/2016 | Wu |
| D770,775 | S | 11/2016 | Robertson |
| D772,678 | S | 11/2016 | Haarburger |
| D775,824 | S | 1/2017 | King |
| D780,449 | S | 3/2017 | King |
| 9,615,641 | B2 | 4/2017 | Yeung |
| 9,648,931 | B2 | 5/2017 | Sha |
| 9,661,908 | B2 | 5/2017 | Mayer |
| D792,749 | S | 7/2017 | Faro |
| D798,591 | S | 10/2017 | King |
| D799,301 | S | 10/2017 | Cetera |
| 9,775,328 | B1 | 10/2017 | Fidrych |
| 9,815,212 | B2 | 11/2017 | Barr |
| D805,770 | S | 12/2017 | Justiss |
| D805,873 | S | 12/2017 | Cetera |
| D806,386 | S | 1/2018 | King |
| D808,158 | S | 1/2018 | King |
| D808,765 | S | 1/2018 | Kisling |
| D809,792 | S | 2/2018 | Moon |
| 9,907,375 | B1 | 3/2018 | Kitchen |
| D814,182 | S | 4/2018 | Haarburger |
| D814,183 | S | 4/2018 | Haarburger |
| D815,932 | S | 4/2018 | Lee |
| D815,935 | S | 4/2018 | Barak |
| D817,196 | S | 5/2018 | Haarburger |
| D817,316 | S | 5/2018 | Srour |
| D818,708 | S | 5/2018 | An |
| D827,408 | S | 9/2018 | Stefanczyk-Lacor |
| D828,023 | S | 9/2018 | Serman |
| D828,024 | S | 9/2018 | Serman |
| D828,025 | S | 9/2018 | Serman |
| 10,080,409 | B2 | 9/2018 | King |
| D831,349 | S | 10/2018 | Deng |
| 10,123,596 | B2 | 11/2018 | King |
| D835,408 | S | 12/2018 | Justiss |
| D835,409 | S | 12/2018 | Justiss |
| D835,410 | S | 12/2018 | Chan |
| D836,335 | S | 12/2018 | Serman |
| D836,336 | S | 12/2018 | Serman |
| D836,914 | S | 1/2019 | Reinhart |
| 10,201,216 | B2 | 2/2019 | Van Geer |
| 10,206,473 | B2 | 2/2019 | Haarburger |
| D842,070 | S | 3/2019 | Kisling |
| D845,623 | S | 4/2019 | Sullivan |
| D856,956 | S | 8/2019 | Liu |
| 10,368,618 | B2 | 8/2019 | Richards |
| D858,984 | S | 9/2019 | Zucco |
| D860,645 | S | 9/2019 | Wu |
| D861,339 | S | 10/2019 | Moon |
| D866,177 | S | 11/2019 | Leh |
| D866,178 | S | 11/2019 | Jin |
| D866,276 | S | 11/2019 | Shlaferman |
| D866,964 | S | 11/2019 | Tran |
| D868,463 | S | 12/2019 | Tran |
| D869,843 | S | 12/2019 | Zhou |
| 10,512,316 | B2 | 12/2019 | Haarburger |
| D875,490 | S | 2/2020 | Barr |
| D877,513 | S | 3/2020 | Duncan |
| D877,594 | S | 3/2020 | Liang |
| D878,891 | S | 3/2020 | Polczynski |
| D878,893 | S | 3/2020 | Kao |
| D879,580 | S | 3/2020 | Spater |
| 10,595,611 | B2 | 3/2020 | Berkley |
| D881,671 | S | 4/2020 | Kao |
| D884,338 | S | 5/2020 | Liu |
| D884,339 | S | 5/2020 | Li |
| D884,792 | S | 5/2020 | Swallow |
| D887,708 | S | 6/2020 | Tran |

(56) References Cited

U.S. PATENT DOCUMENTS

| | | | | |
|---|---|---|---|---|
| D887,709 | S | 6/2020 | Fenton | |
| D890,525 | S | 7/2020 | Leh | |
| D891,101 | S | 7/2020 | Lv | |
| D891,767 | S | 8/2020 | Lamb | |
| D893,975 | S | 8/2020 | Tran | |
| D895,276 | S | 9/2020 | Leh | |
| D895,961 | S | 9/2020 | Swan | |
| D895,963 | S | 9/2020 | Anderson | |
| D896,506 | S | 9/2020 | Anderson | |
| 10,791,808 | B2 | 10/2020 | Kane | |
| D904,016 | S | 12/2020 | Jacobsen | |
| D904,143 | S | 12/2020 | Hollinger | |
| D908,351 | S | 1/2021 | Hoffman | |
| D908,352 | S | 1/2021 | Pirker | |
| D909,059 | S | 2/2021 | Leh | |
| D915,066 | S | 4/2021 | Blackrock | |
| D915,765 | S | 4/2021 | Quittner | |
| D917,879 | S | 5/2021 | Chui | |
| D918,002 | S | 5/2021 | Borenstein | |
| D930,634 | S | 9/2021 | Azodi | |
| D930,981 | S | 9/2021 | Ghazzaoui | |
| D932,182 | S | 10/2021 | Foy | |
| D933,360 | S | 10/2021 | Qing | |
| D934,560 | S | 11/2021 | Tran | |
| 11,178,947 | B2 | 11/2021 | Tran | |
| 11,284,689 | B1 | 3/2022 | Duncan | |
| 11,311,087 | B2 | 4/2022 | Del Moral | |
| D950,240 | S | 5/2022 | Tran | |
| D950,241 | S | 5/2022 | Tran | |
| D951,632 | S | 5/2022 | Tran | |
| 11,337,498 | B2 | 5/2022 | Tran | |
| 2002/0157745 | A1* | 10/2002 | Stodghill | A45C 1/06 150/145 |
| 2002/0179463 | A1 | 12/2002 | Newman | |
| 2004/0148837 | A1 | 8/2004 | Lewis | |
| 2005/0035006 | A1 | 2/2005 | Dohner | |
| 2007/0109130 | A1 | 5/2007 | Edenfield | |
| 2008/0314483 | A1 | 12/2008 | Armstrong | |
| 2009/0199940 | A1 | 8/2009 | Toner | |
| 2011/0308972 | A1 | 12/2011 | Streem | |
| 2012/0228168 | A1 | 9/2012 | Kitchen | |
| 2013/0056119 | A1 | 3/2013 | Henriette | |
| 2013/0135103 | A1 | 5/2013 | Holloway | |
| 2013/0276943 | A1 | 10/2013 | Minn et al. | |
| 2014/0143958 | A1 | 5/2014 | Barr | |
| 2015/0083289 | A1 | 3/2015 | Johnson | |
| 2015/0240524 | A1 | 8/2015 | Olroyd | |
| 2015/0257499 | A1 | 9/2015 | Muir | |
| 2015/0282579 | A1 | 10/2015 | Piro | |
| 2016/0022000 | A1 | 1/2016 | Tucker-Skow | |
| 2016/0206065 | A1 | 7/2016 | Ehrlich | |
| 2016/0324283 | A1 | 11/2016 | Kane | |
| 2016/0374443 | A1 | 12/2016 | Kim | |
| 2017/0035169 | A1 | 2/2017 | Haarburger | |
| 2017/0055654 | A1 | 3/2017 | King | |
| 2017/0119115 | A1 | 5/2017 | King | |
| 2017/0135452 | A1 | 5/2017 | Kane | |
| 2017/0224077 | A1 | 8/2017 | Mayer | |
| 2017/0265610 | A1 | 9/2017 | Smith | |
| 2018/0027935 | A1 | 2/2018 | Laatz | |
| 2018/0064223 | A1 | 3/2018 | Singer | |
| 2018/0311804 | A1 | 11/2018 | Weinberger | |
| 2018/0325228 | A1 | 11/2018 | Leimer | |
| 2018/0332936 | A1 | 11/2018 | Serman | |
| 2018/0368547 | A1 | 12/2018 | Grannan | |
| 2019/0008253 | A1 | 1/2019 | Deng | |
| 2019/0318667 | A1 | 10/2019 | Freeman | |
| 2019/0365066 | A1 | 12/2019 | Hill | |
| 2020/0077758 | A1 | 3/2020 | Hoffman | |
| 2020/0229557 | A1 | 7/2020 | Tran | |
| 2020/0305564 | A1 | 10/2020 | Myers | |
| 2020/0379509 | A1 | 12/2020 | Coward | |
| 2021/0112935 | A1 | 4/2021 | Tran | |
| 2021/0330045 | A1 | 10/2021 | Tran | |
| 2021/0337945 | A1 | 11/2021 | Popoff | |
| 2022/0225742 | A1 | 7/2022 | Tran | |

FOREIGN PATENT DOCUMENTS

| | | |
|---|---|---|
| CN | 306924723 | 11/2021 |
| KR | 101356236 | 1/2014 |
| KR | 20140003803 U | 6/2014 |

OTHER PUBLICATIONS

Onward Innovation—"RFID Carbon Fiber Cash Strap Wallet"—Downloaded Jun. 11, 2022—Available from Internet <URL: https://onwardinnovation.com/products/rfid-carbon-fiber-cash-strap-wallet>.

Ridge—"Aluminum—Black"—Downloaded Apr. 9, 2021—Available from Internet <URL: https://ridge.com/products/aluminum-black?>.

Titan X—"Titan X | Pro Edition"—Downloaded Jun. 11, 2022—Available from Internet <URL: https://titanxwallet.com/products/edition>.

Alpine Swiss—"Alpine Swiss Genuine Leather Super Thing Slim Cash Strap Front Pocket Wallet"—Downloaded Apr. 9, 2021—Available from Internet <URL: https://www.alpineswiss.com/alpine-swiss-genuine-leather-super-thin-slim-cash-strap-front-pocket-wallet/>.

Simple Zone—"Carbon Fiber Wallet for Men, Simple Zone RFID Blocking Slim Minimalist Card Holder Wallet with Money Clip and Cash Strap"—First available Jun. 18, 2020—Downloaded Apr. 9, 2021—Available from Internet <URL: https://www.amazon.com/Carbon-Simple-Zone-Blocking-Minimalist/dp/B08BG4G8GJ>.

Dango Products—"T01 Tactical Bifold Wallet—Spec-Ops—Blueline"—Downloaded Apr. 9, 2021—Available from Internet <URL: https://www.dangoproducts.com/products/t01-tactical-bifold-wallet-blueline-spec-ops?variant=21433891881044>.

Dango Products—"Dango M1 Maverick Wallet—CNC-Machined Aluminum, RFID Blocking, Made in USA"—First available Jan. 12, 2019—Downloaded Jun. 11, 2022—Available from Internet <URL: https://www.amazon.com/dp/B07MMDRGCV>.

Dango Products—"Dango Products—M1 Maverick Bifold Wallet"—Video by user Dango Products—First available Nov. 29, 2018—Downloaded May 24, 2021—Available from Internet <URL: https://www.youtube.com/watch?v=kqF_xCWWLOU>.

Muradin—"Muradin Dapper Leather Bifold Wallet—Genuine Tactical Wallet—Card Wallet for Men—RFID-Blocking Aluminum Metal Wallet"—First available Nov. 22, 2020—Downloaded May 24, 2021—Available from Internet <URL: https://www.amazon.com/MURADIN-Dapper-Leather-Bifold-Wallet/dp/B07ZPXH81N?th=1>.

Dango Products—"A10 Adapt Wallet"—Downloaded May 25, 2021—Available from Internet <URL: https://www.dangoproducts.com/collections/a-series-wallets/products/a10-adapt-wallet>.

Hanker—"Carbon Fiber Aluminum Metal Minimalist Wallet RFID Blocking Credit Card Holder Money Clip"—First available Feb. 7, 2019—Downloaded May 25, 20219—Available from Internet <URL: https://www.amazon.com/Carbon-Aluminum-Minimalist-Wallet-Blocking/dp/B07NHK6P55>.

EELV—"ELV Badge Holder Wallet, Aluminium ID Badge Card Holder Heavy Duty with Quick Release Button, Metal Clip for Offices ID, School ID, Driver Licence, Wallet, Holds 1-4 Cards"—First available Jan. 21, 2019—Downloaded Jun. 11, 2022—Available from Internet <URL: https://www.amazon.com/ELV-Aluminum-Release-Offices-License/dp/B07MZJYVBX/>.

Elephant Wallett—"N Wallet Carbon Fiber—Fabric Rubber"—Downloaded Mar. 17, 2021—Available from Internet <URL: https://elephantwallet.com/products/n-wallet-carbon-fiber>.

Elephant Wallet—"How Does It Work (X Wallet)"—Downloaded Mar. 17, 2021—Available from Internet <URL: https://elephantwallet.com/pages/how-does-it-work>.

Wallet Gear—"Bifold Leather Wallet with Elastic Band"—Downloaded Mar. 17, 2021—Available from Internet <URL: https://www.walletgear.com/bifold-leather-wallet-with-elastic-band.html>.

(56) References Cited

OTHER PUBLICATIONS

Curated Basics—"Elastic Band Minimalist Wallet"—Downloaded Mar. 17, 2021—Available from Internet <URL: https://www.curatedbasics.com/products/elastic-band>.
Dango Products—"Dango D03 Dapper Bifold EDC Wallet—Made in USA—Genuine Leather, Slim, Minimalist, Metal, RFID Blocking"—Downloaded Jun. 11, 2022—Available at least as of Apr. 22, 2021 (first review)—Available from Internet <URL: https://www.amazon.com/Dango-D03-Dapper-Bifold-Wallet/dp/B0925CV8CK?ref_=ast_sto_dp&th=1>.
Dango Products—"D03 Dapper Bifold Wallet"—Downloaded Jun. 11, 2022—Available from Internet <URL: https://www.dangoproducts.com/products/d03-dapper-wallet>.
Dango Products—"Dango Products: D03 Dapper Bifold Wallet"—Video by user Dango Products—First available Apr. 20, 2021—Downloaded Nov. 24, 2021—Available from Internet <URL: https://www.youtube.com/watch?v=QSLs3ABQcoY>.
Dango Products—"A10 Bifold Pen Adapter"—Video by user Dango Products—First available Jul. 15, 2020—Downloaded Nov. 24, 2021—Available from Internet <URL: https://www.youtube.com/watch?v=7y6fXT8Y0SI>.
Dango Products—"A10 Adapt Bifold Pen Wallet"—Downloaded Jun. 11, 2022—Available from Internet <URL: https://www.dangoproducts.com/products/a10-adapt-bifold-pen-wallet>.
Dango Products—"Dango M1 Maverick Rail EDC Wallet—Made in USA—All-Metal, Minimalist, Slim, RFID Blocking"—First Available Oct. 9, 2019—Downloaded Nov. 24, 2021—Available from Internet <URL: https://www.amazon.com/Dango-M1-Maverick-Rail-Wallet/dp/B07YWJWK9Z>.
Dango Products—"Dango M1 Maverick Rail Wallet"—First Available Oct. 7, 2019—Downloaded Nov. 24, 2021—Available from Internet <URL: https://www.youtube.com/watch?v=5xTPdgAZkL8>.
Dango Products—"M1 Maverick Rail Wallet"—Downloaded Nov. 24, 2021—Available from Internet <URL: https://www.dangoproducts.com/products/m1-maverick-rail-wallet.
Anvi Original—"MiniCap 1.0/2.0 Mens RFID Blocking Front Pocket Minimalist Slim Wallet With Pull Tab Money Clip"—First available Sep. 14, 2018—Downloaded Nov. 11, 2021—Available from Internet <URL: https://www.amazon.com/Minicap1-0-Blocking-Pocket-Minimalist-Wallet/dp/B07HCD1BRR>.
Leatheram—"Handmade pull up card holder, leather credit card case with pull tab, minimalist wallet, thin minimal wallet"—Available at least as of Dec. 14, 2019—Downloaded Jun. 11, 2022—Available from Internet <URL: https://www.etsy.com/listing/235786494/>.
Enigma—"MURADIN Chocolate Front Pocket Wallet for Men Travel Tactical bifold RFID Blocking Aluminum Metal Leather Money Cards Holder Ideal Men's Gift"—Available at least as of Jul. 6, 2021—Downloaded Jun. 11, 2022—Available from Internet <URL: https://www.amazon.com/MURADIN-Chocolate-Tactical-Blocking-Aluminum/dp/B097SKPGJP>.
Nite Ize—"Nite Ize Financial Tool, Multi Tool Money Clip, Minimalist Wallet, Money Clip, Multi Tool, and Credit Card Holder Combo, Stainless Steel"—First available Mar. 1, 2018—Downloaded Jun. 11, 2022—Available from Internet <URL: https://www.amazon.com/gp/product/B078KZSGKR>.
Safe Price—"Stainless Steel Men Money Clip Elastic Band Slim Credit Card Holder Wallet Purse (Silver)"—First available Sep. 20, 2017—Downloaded Jul. 29, 2021—Available from Internet <URL: https://www.amazon.com/Stainless-Elastic-Credit-Holder-Wallet/dp/B075S95PQ7?th=1>.
Micrometalinc—"Titanium Money Clip | Bottle Opener | CNC: 65MC43753F2 | 1x Money Clip"—Available at least as of May 13, 2020—Downloaded Jun. 11, 2022—Available from Internet < URL: https://www.etsy.com/listing/974788562>.
TI-EDC—"TI-EDC Titanium Slim Cash Money Clip Wallet Credit Card Holder and Bottle Opener"—First Available Dec. 10, 2013—Downloaded Jun. 11, 2022—Available from Internet <URL: https://www.amazon.com/TI-EDC-Titanium-Wallet-Credit-Holder/dp/B00H7UHZZY>.
Cheers All—"Beer Opener Money Clip"—Downloaded Jun. 11, 2022—Available from Internet <URL: https://cheersall.com/products/beer-opener-money-clip>.
Nomatic—Wallet—Downloaded Jun. 11, 2022—Available from Internet <URL: https://www.nomatic.com/products/wallet>.
Distil—Wally Bifold Classic—Downloaded Jun. 11, 2022—Available from Internet <URL: https://distilunion.com/products/wally-bifold>.
ENIGMA—ENIGMA Dapper PU Leather Bifold Front Pocket Slim Wallet for Men, Aluminum Metal Travel Tactical RFID Blocking Card Holder Money Clip, Ideal Men's Gift—Available at least as of Jul. 13, 2021—Downloaded Jun. 11, 2022 Available from Internet < https://www.amazon.com/ENIGMA-Leather-Aluminum-Tactical-Blocking/dp/B097RCJJVJ>.
Dango Products—"Dango Products—M1 Maverick Bifold Wallet Spec-Ops Edition"—First Available Nov. 29, 2018—Downloaded Nov. 23, 2021—Available from Internet <URL: https://www.youtube.com/watch?v=KSFzWMDOTAc>.
Dango Products—"Dango Products—MT01 Clasp Multi-Tool"—First Available Mar. 19, 2019—Downloaded Nov. 23, 2021—Available from Internet <URL: https://www.youtube.com/watch?v=7SVGTLoDUsE>.
Dango Products—"A10 Adapt Wallet"—Downloaded Jun. 11, 2022—Available from internet <URL: https://www.dangoproducts.com/collections/a-series-wallets/products/a10-adapt-wallet>.
Dango Products—"Dango Products—A10 Adapt Wallet"—First available: Jul. 15, 2020—Downloaded Jun. 11, 2022—Available from internet <URL: https://www.youtube.com/watch?v=EheKLMq84-8>.
Dango Products—"M1 Maverick Wallet"—Downloaded Sep. 8, 2022—Available from Internet <URL: https://www.dangoproducts.com/collections/m1-maverick-wallets/products/m1-maverick-tactical-bifold-wallet-raw>.
Dango Products—"D01 Dapper Wallet"—Downloaded Sep. 8, 2022—Available from Internet <URL: https://www.dangoproducts.com/products/d01-dapper-wallet>.
Dango Products—"Dango Products—A10 Pull Pocket Adapter"—Video by user Dango Products—First available Feb. 17, 2021—Downloaded Sep. 30, 2022—Available from Internet <URL: https://www.youtube.com/watch?v=DTIdZDIBk2l>.

* cited by examiner

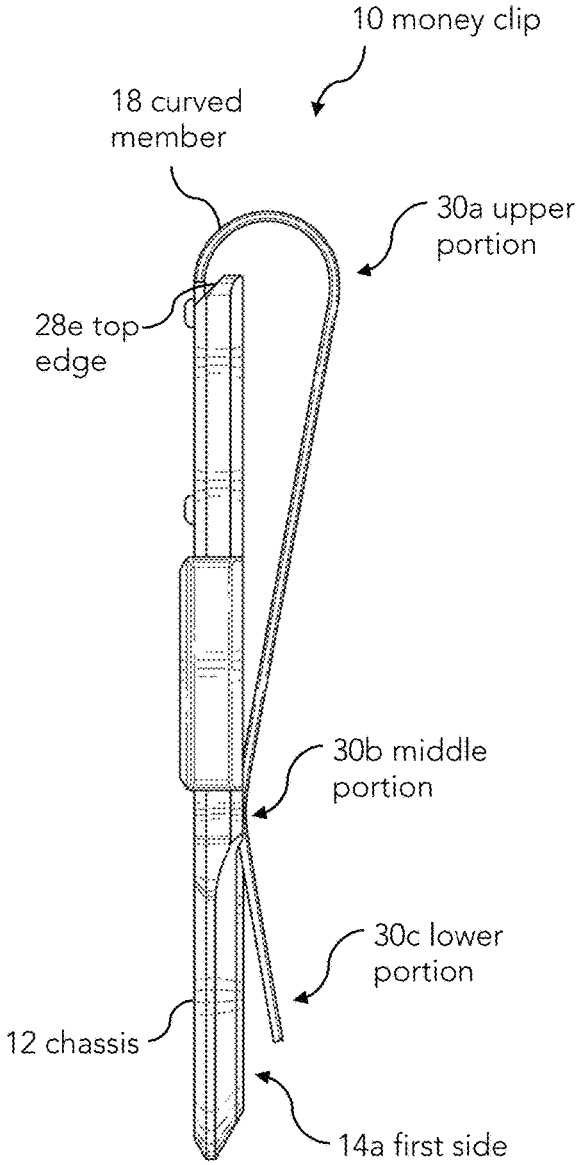
Figure 10A
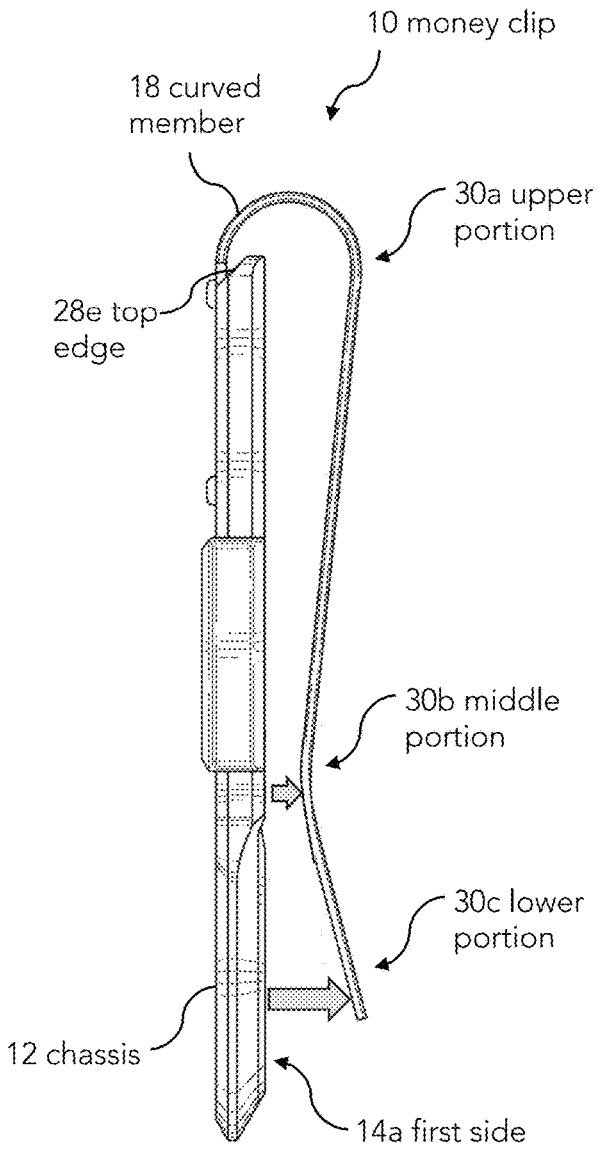
Figure 10B
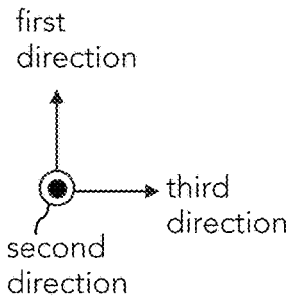

MONEY CLIP

CROSS-REFERENCE TO RELATED APPLICATIONS

The entire contents of the following application are incorporated by reference herein: U.S. application Ser. No. 17/489,015; filed Sep. 29, 2021; issued as U.S. Pat. No. 11,425,976 on Aug. 30, 2022; and entitled MONEY CLIP.

BACKGROUND

Field

Various embodiments disclosed herein generally relate to money clips. More specifically, the present disclosure relates to money clips with a dual piece metal construction and a stretchable band.

Description of Related Art

Money clips are designed to carry articles such as credit cards, currency, business cards, pictures, identification cards (such as a driver's license or work ID), plus assorted other paper items. The most common type of money clip is constructed of a single piece of bended metal, where paper currency, cards, etc. are held between the two sections of the metal piece. Traditional money clips commonly fail to retain a degree of flexibility, so that after a period of holding a large quantity of cards and/or currency they become "loose" and can no longer securely hold a smaller quantity of cards and/or currency, leaving the cards and/or currency vulnerable to being lost. In addition, traditional money clips may be unorganized, as they don't allow for separation of currency from cards and/or separation of large bills from small bills. There is therefore a need for an improved type of money clip to hold a high capacity of cards and currency while maintaining a degree of flexibility and allowing for greater organization of the cards and currency.

SUMMARY

The disclosure includes a money clip comprising a chassis defining a first side, a second side located opposite the first side, a top portion, and a bottom portion located opposite the top portion, a curved member mechanically coupled to the second side of the chassis adjacent the top portion, the curved member configured to curve around the top portion to the first side of the chassis, the curved member terminating adjacent the bottom portion, and a stretchable band configured to wrap around the chassis, a first portion of the stretchable band located between the first side of the chassis and the curved member and a second portion of the stretchable band located on the second side of the chassis. In some embodiments, the stretchable band is configured to receive and retain at least one of at least one personal card and at least one paper bill to the chassis. The stretchable band may be configured to provide friction between the curved member and the first side of the chassis to enable the money clip to retain the at least one of at least one personal card and at least one paper bill between the curved member and the first side of the chassis.

The chassis may define a first edge and a second edge located opposite the first edge, each of the first edge and the second edge configured to extend between the top portion and the bottom portion. The stretchable band may be configured to wrap around the chassis such that it contacts at least one of the first side, the second side, the first edge, and the second edge. In some embodiments, the first edge defines a length less than a second edge, and the chassis further defines a third edge configured to extend from a bottom portion of the first edge to a bottom edge of the chassis.

The chassis may extend along a first direction and the stretchable band may wrap around the chassis along a second direction perpendicular to the first direction. In some embodiments, at least a portion of the curved member is offset from the chassis along a third direction that is perpendicular to the first direction and the second direction. The curved member may comprise an upper portion, a middle portion, and a lower portion, wherein the upper portion may be physically spaced from the chassis by a first length, the lower portion may be physically spaced from the chassis by a second length, and the middle portion may be physically spaced from the chassis by a third length that is less than the first length and the second length. In some embodiments, the middle portion is configured to contact the first side of the chassis. The second length may be less than the first length.

In some embodiments, the upper portion of the curved member is physically spaced along the first direction from a top edge of the chassis and along the third direction from the first side of the chassis. The lower portion of the curved member may be physically spaced along the third direction from the first side of the chassis, and the middle portion may be configured to move along the third direction to receive at least one of at least one personal card and at least one paper bill, thereby retaining the at least one of at least one personal card and at least one paper bill between the curved member and the first side of the chassis.

The money clip may further comprise a first aperture located on the curved member adjacent the top portion of the chassis and a second aperture located on the chassis adjacent the bottom portion. In some embodiments, the first aperture and the second aperture are configured to receive at least one attaching member, wherein the at least one attaching member comprises at least one of a keyring, a lanyard, a clip, and a tether. The money clip may also further comprise a bottle opener located on the curved member adjacent the top portion of the chassis, the bottle opener defining an angled aperture configured to receive at least a portion of a bottle cap.

In some embodiments, the money clip further comprises a first set of at least one aperture located on the chassis, a second set of at least one aperture located on a front face of the curved member, and a third set of at least one aperture located on a back face of the curved member. The front face may be located adjacent the first side of the chassis and the back face may be coupled to the second side of the chassis. In some embodiments, the first set of at least one aperture is substantially aligned with the third set of at least one aperture. The at least one aperture of at least one of the first set, the second set, and the third set may be configured to allow a user to view at least one of at least one personal card and at least one paper bill coupled to the money clip.

In some embodiments, the chassis defines a first edge and a second edge located opposite the first edge, wherein each of the first edge and the second edge is configured to extend along a first direction between the top portion and the bottom portion. The chassis may further define a third edge configured to extend along a first angled direction that is not perpendicular to the first direction. In some embodiments, the stretchable band is configured to wrap around the chassis along a second direction perpendicular to the first direction. The first set of at least one aperture and the third set of at least one aperture may be configured to extend along the second direction. The second set of at least one aperture may be configured to extend along a second angled direction that is perpendicular to the first angled direction.

The chassis may further define a top edge extending along the second direction between the first edge and the second edge, and a bottom edge extending along the second direction between the third edge and the second edge. At least a portion of at least one of the first edge, the second edge, the third edge, the top edge, and the bottom edge may comprise a beveled edge. In some embodiments, the bottom edge comprises a bottom aperture defining a first side located adjacent the first side of the chassis and a second side located adjacent the second side of the chassis, wherein the first side of the bottom aperture does not comprise the beveled edge and the second side of the bottom aperture comprises the beveled edge. The bottom aperture may extend along the second direction.

In some embodiments, the chassis comprises aluminum, the curved member comprises a titanium alloy, and the stretchable band comprises silicone.

A first edge and a second edge of the chassis may extend along a first direction, the stretchable band may wrap around the chassis along a second direction perpendicular to the first direction, and a third edge of the chassis may extend along a first diagonal direction that is not perpendicular to the first direction or the second direction. In some embodiments, the curved member comprises an upper portion, a middle portion, and a lower portion, wherein the upper portion and the lower portion are configured to be physically spaced from the first side of the chassis along a third direction that is perpendicular to the first direction and the second direction. The upper portion may comprise a bottle opener. In some embodiments, the stretchable band is configured to receive and retain at least one of at least one personal card and at least one paper bill. The stretchable band may be configured to provide friction between the curved member and the first side of the chassis to enable the money clip to retain the at least one of at least one personal card and at least one paper bill between the curved member and the first side of the chassis.

In some embodiments, the money clip further comprises a first set of at least one aperture located on the chassis, a second set of at least one aperture located on a front face of the curved member, and a third set of at least one aperture located on a back face of the curved member. The front face may be located adjacent the first side of the chassis and the back face may be coupled to the second side of the chassis. In some embodiments, the first set comprises at least one aperture located on a bottom portion of the chassis and at least one aperture located on a top portion of the chassis, each aperture of the first set extending along the second direction. The second set may comprise at least one aperture extending along a second angled direction perpendicular to the first angled direction. The third set may comprise at least one aperture extending along the second direction.

In some embodiments, the first set comprises a first aperture located on the bottom portion. The first aperture may define a first length. The first set may also comprise a second aperture located on the bottom portion, and the second aperture may define a second length. In some embodiments, the first set comprises a third aperture located on the bottom portion, and the third aperture defines a third length. The third length may be less than the first length and the second length, and the second length may be less than the first length. In some embodiments, the first set further comprises a fourth aperture located on the top portion, and the fourth aperture defines a fourth length. The first set may comprise a fifth aperture located on the top portion, and the fifth aperture may define a fifth length. In some embodiments, the fourth length and the fifth length are substantially equal to the first length.

The second set may comprise two apertures extending along the second angled direction. In some embodiments, the third set comprises two apertures extending along the second direction, wherein each of the two apertures is substantially aligned with the fourth aperture and the fifth aperture.

The disclosure includes a money clip comprising a chassis defining a first side and a second side located opposite the first side, and a first coupling element coupled to the chassis, the first coupling element configured to retain a personal effect selected from the group consisting of a personal card, a paper bill, and combinations thereof, between the first coupling element and the first side of the chassis. The money clip may also comprise a second coupling element coupled to the chassis, the second coupling element configured to retain a personal effect selected from the group consisting of a personal card, a paper bill, and combinations thereof, between the second coupling element and the second side of the chassis. In some embodiments, the first coupling element is configured to overlap the second coupling element.

The first coupling element may be mechanically coupled to the second side of the chassis. In some embodiments, the first coupling element extends from the second side of the chassis to the first side of the chassis. The first coupling element may comprise a curved member that may extend from the first side of the chassis to the second side of the chassis. In some embodiments, the second coupling element comprises a stretchable band configured to wrap around the chassis. The stretchable band may be configured to provide friction to enable the money clip to retain the personal effect selected from the group consisting of a personal card, a paper bill, and combinations thereof, between the first coupling element and the first side of the chassis.

In some embodiments, the chassis extends along a first direction and the stretchable band wraps around the chassis along a second direction perpendicular to the first direction, wherein at least a portion of the first coupling element is offset from the chassis along a third direction that is perpendicular to the first direction and the second direction. The first coupling element may be configured to flex along the third direction to thereby couple the personal effect selected from the group consisting of a personal card, a paper bill, and combinations thereof, against the first side of the chassis. In some embodiments, the stretchable band is configured to flex along the third direction to thereby couple the personal effect selected from the group consisting of a personal card, a paper bill, and combinations thereof, against the second side of the chassis.

The money clip may further comprise at least one aperture located on the first coupling element adjacent a top portion of the chassis. In some embodiments, the money clip includes a bottle opener located on the first coupling element adjacent the top portion of the chassis, the bottle opener defining an angled aperture configured to receive at least a portion of a bottle cap. The at least one aperture may comprise two apertures.

In some embodiments, the first coupling element comprises four apertures located adjacent the first side of the chassis. The first coupling element may define a curved shape, and may be configured to withstand repeated bending while retaining the curved shape. In some embodiments, wherein the first coupling element is comprised of a titanium alloy. The chassis may be comprised of aluminum. In some embodiments, a combination of the aluminum and the titanium alloy enables the money clip to block a radio frequency identification (RFID) signal.

The chassis may define a first color. In some embodiments, the first coupling element defines a second color that is different from the first color. The personal card may define a first width and the money clip may define a second width that is larger than the first width.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

FIGS. 9, 10A, and 10B illustrate side views of a money clip, according to some embodiments.

DETAILED DESCRIPTION

Figure 1:
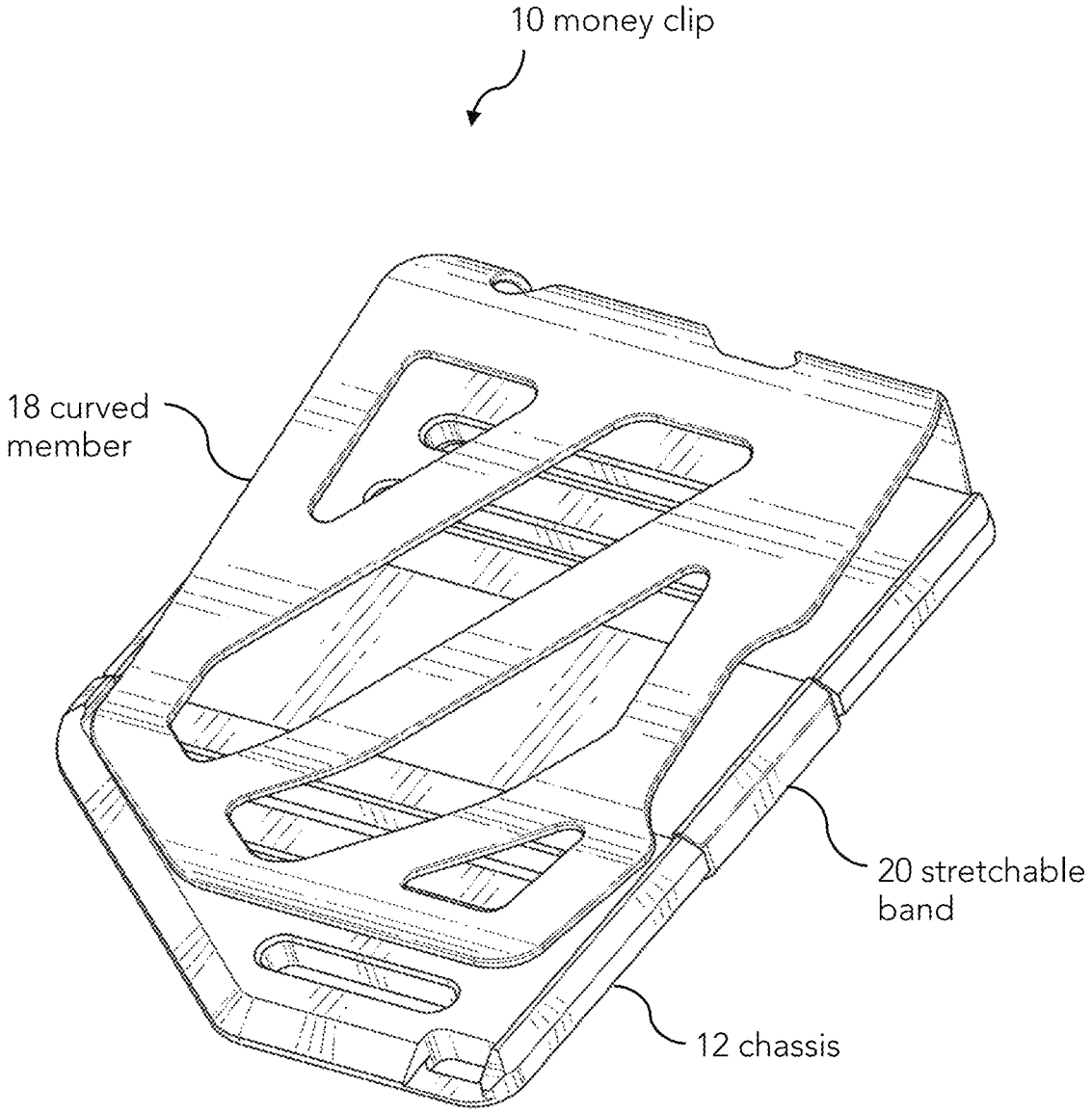
FIG. 1 illustrates a front perspective view of a money clip, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

REFERENCE NUMERALS

10—money clip
12—chassis
14*a*—first side (of chassis)
14*b*—second side (of chassis)
16*a*—top portion (of chassis)
16*b*—bottom portion (of chassis)
18—curved member
20—stretchable band
22*a*—first portion (of stretchable band)
22*b*—second portion (of stretchable band)
24—at least one personal card
26—at least one paper bill
28*a*—first edge (of chassis)
28*b*—second edge (of chassis)
28*c*—third edge (of chassis)
28*d*—bottom edge (of chassis)
28*e*—top edge (of chassis)
30*a*—upper portion (of curved member)
30*b*—middle portion (of curved member)
30*c*—lower portion (of curved member)
32*a*—first length
32*b*—second length
34*a*—first aperture
34*b*—second aperture
36—bottle opener
38—angled aperture
40*a*—first set of at least one aperture
40*b*—second set of at least one aperture
40*c*—third set of at least one aperture
42*a*—front face (of curved member)
42*b*—back face (of curved member)
44—at least one attaching mechanism
100—money clip
102—chassis
104*a*—first side (of chassis)
104*b*—second side (of chassis)
106—first coupling element
108—second coupling element
110—personal card
112—curved member
114—stretchable band
116—at least one aperture
118—top portion (of chassis)
120—bottle opener
122—apertures
124*a*—first width
124*b*—second width

Introduction

The disclosure includes multiple embodiments of a money clip. In some embodiments, the money clip comprises a dual-piece construction with a stretchable band configured to wrap around a chassis of the money clip. The money clip may be configured to hold multiple personal cards, such as credit cards, identification cards, business cards, membership cards (e.g., grocery store rewards card, gym membership, library card), gift cards, and the like. Multiple embodiments may also be configured to hold paper currency, coupons, photographs, and other paper items.

FIG. 1 illustrates a front perspective view of a money clip 10. In some embodiments, as shown in FIG. 1, the money clip 10 comprises a chassis 12, a curved member 18, and a stretchable band 20. The stretchable band 20 may be configured to wrap around the chassis 12. As mentioned previously in this disclosure, traditional money clips are often comprised of a single piece of bended metal. This single piece of bended metal may fail to retain its shape over time, resulting in a loose money clip that cannot securely hold personal cards and/or paper currency. In addition, traditional money clips usually only have one usable side, like the side shown in FIG. 2 where the money clip 10 is configured to receive and retain at least one personal card and/or at least one paper bill between the curved member 18 and the chassis 12.

Figure 2:
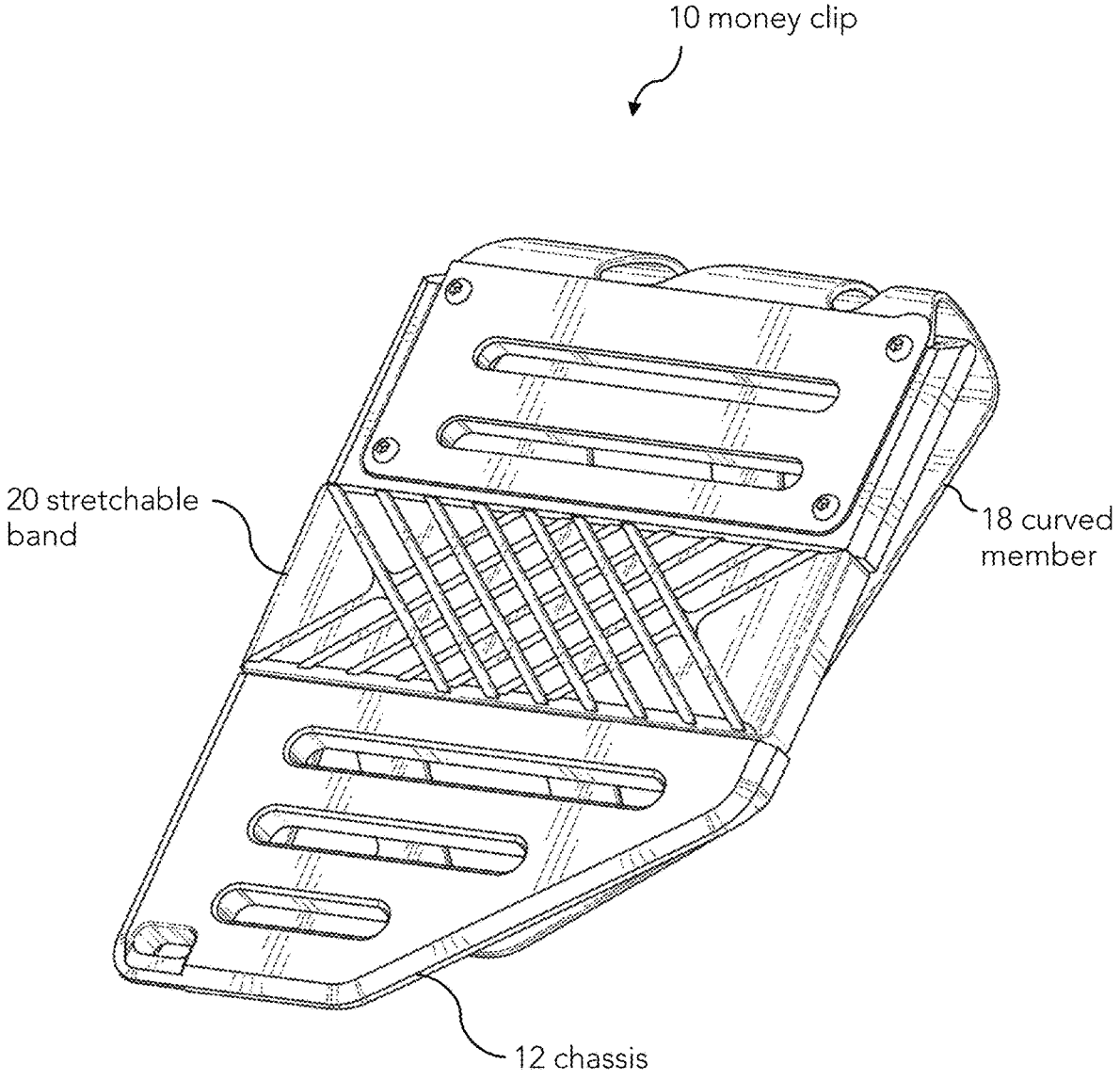
FIG. 2 illustrates a back perspective view of a money clip, according to some embodiments.
Figure 7:
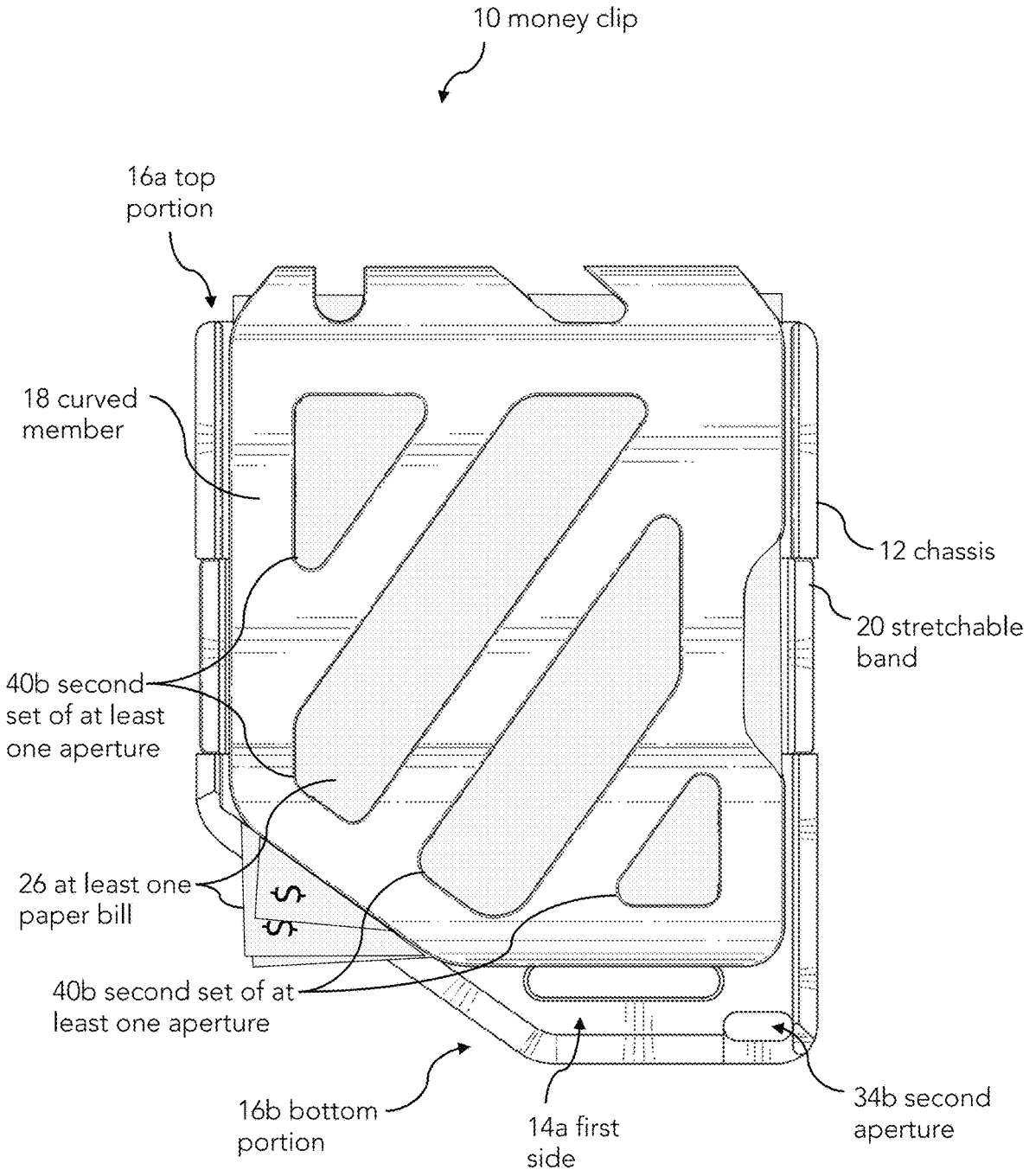
FIG. 7 illustrates a front view of a money clip coupled to at least one paper bill, according to some embodiments.
Figure 8:
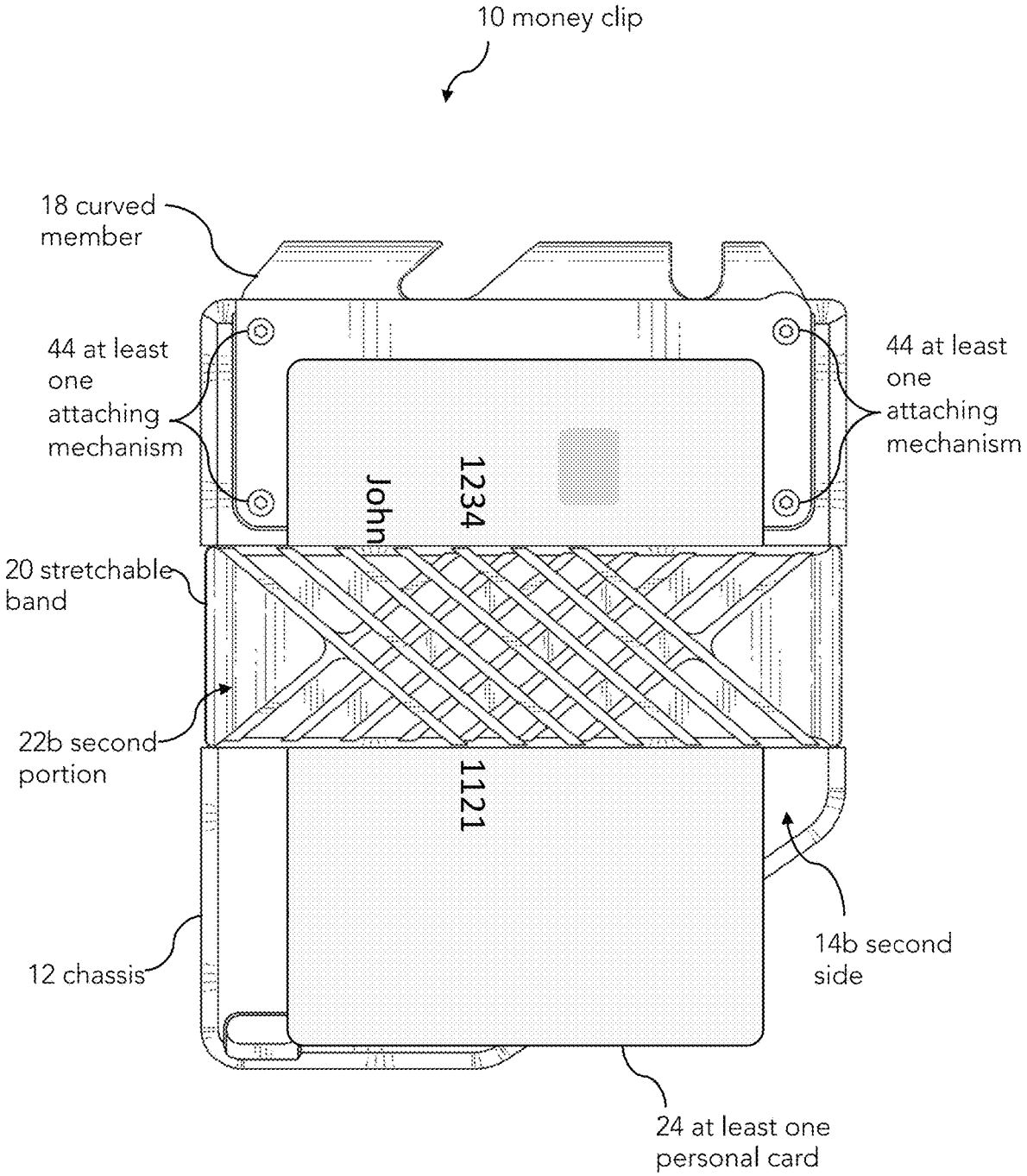
FIG. 8 illustrates a back view of a money clip coupled to at least one personal card, according to some embodiments.

In contrast, as illustrated in FIG. 2, the money clip 10 comprises two separate components—the chassis 12 and the curved member 18. In some embodiments, as illustrated in the back perspective view of FIG. 2, the curved member 18 is coupled to a back portion of the chassis 12. Also shown in FIG. 2 is the stretchable band 20. The inclusion of the stretchable band 20 may enable a user of the money clip 10 to store at least one personal card and/or at least one paper bill on both sides of the money clip 10. For example, in some embodiments, the stretchable band 20 is configured to receive and retain at least one personal card and/or at least one paper bill between the stretchable band 20 and the chassis 12. On the other side of the chassis 12, the curved member 18 may be configured to also receive and retain at least one personal card and/or at least one paper bill between the curved member 18 and the chassis 12. FIGS. 7 and 8 illustrate the money clip 10 holding at least one paper bill 26 (FIG. 7) and at least one personal card 24 (FIG. 8), and will be discussed in greater detail later in the disclosure.

As previously discussed, the money clip 10 comprises a dual-piece construction, including the chassis 12 and the curved member 18. The chassis 12 and the curved member 18 may comprise metal components. In some embodiments, the chassis 12 comprises aluminum and the curved member 18 comprises a titanium alloy. At least one of the chassis 12 and the curved member 18 may comprise different materials than aluminum and titanium. The curved member 18 may comprise any material that is strong and also bendable, such that it is configured to retain a bended shape without stressing and/or cracking over time. The money clip 10 may be thought of as comprising a tri-piece construction, including the chassis 12, the curved member 18, and the stretchable band 20. The stretchable band 20 may comprise silicone. The stretchable band 20 may comprise another flexible, stretchable material, such as elastic, rubber, or a similar material.

In some embodiments, the combination of different materials comprising the money clip 10 provides friction (or "grip") that facilitates more secure retention of at least one personal card and/or at least one paper bill. For example, the material of the stretchable band 20 may provide friction between the curved member 18 and the chassis 12 to enable the money clip 10 to retain at least one personal card and/or at least one paper bill between the curved member 18 and the chassis 12. In some embodiments, without the stretchable band 20, the money clip 10 comprises only metal elements and there is little to no friction between the chassis 12 and the curved member 18. In such an embodiment, the money clip 10 relies purely on the strength of the curved member 18 bending toward the chassis 12 (i.e., "squeezing" strength between the curved member 18 and the chassis 12) to hold at least one personal card and/or at least one paper bill between the chassis 12 and the curved member 18. The addition of the stretchable band 20 introduces a different material, and greater friction, between the chassis 12 and the curved member 18, and provides something for the at least one personal card and/or at least one paper bill to "grip" onto, in addition to the "squeezing" strength between the curved member 18 and the chassis 12.

Figure 3:
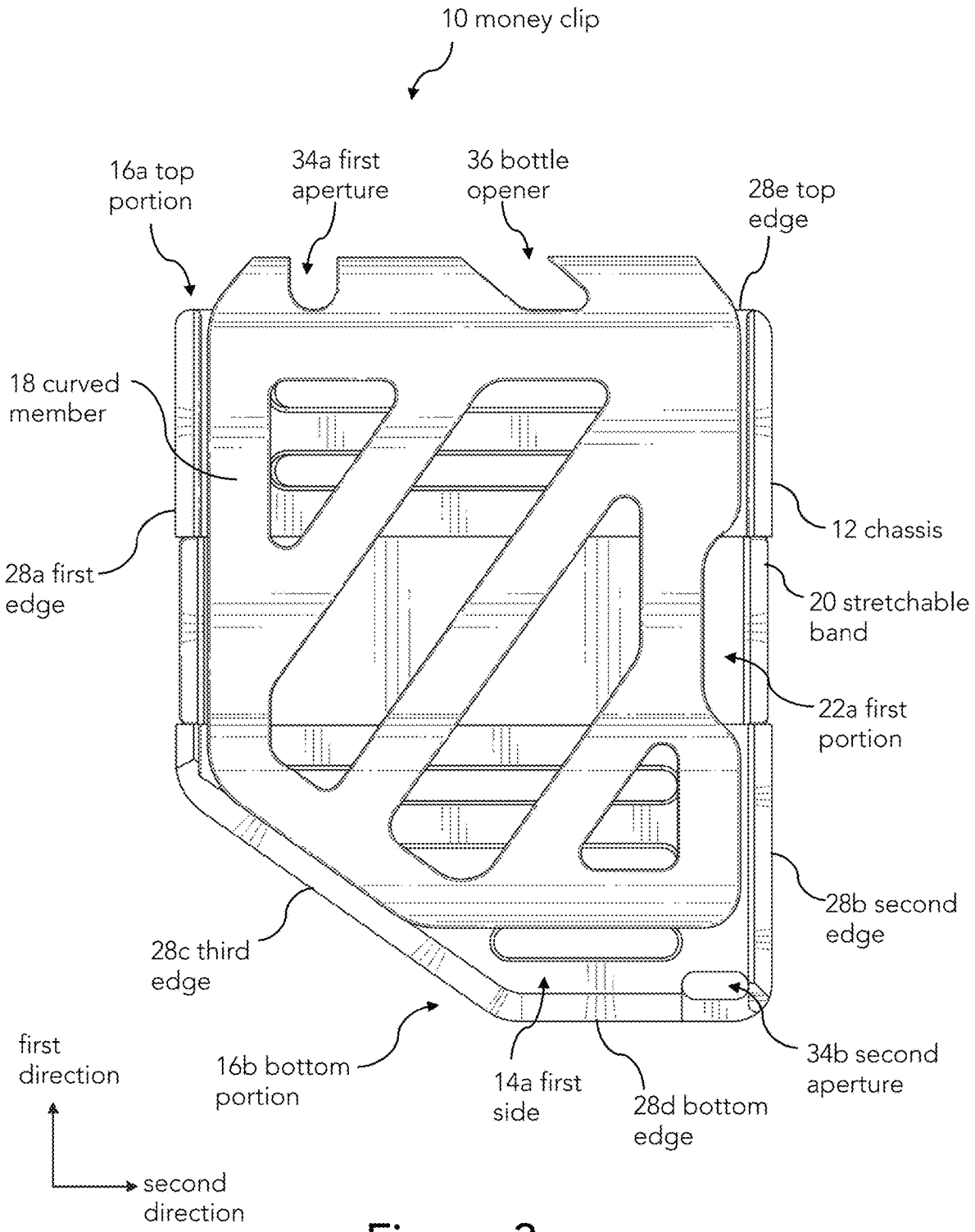
FIG. 3 illustrates a front view of a money clip, according to some embodiments.
Figure 4:
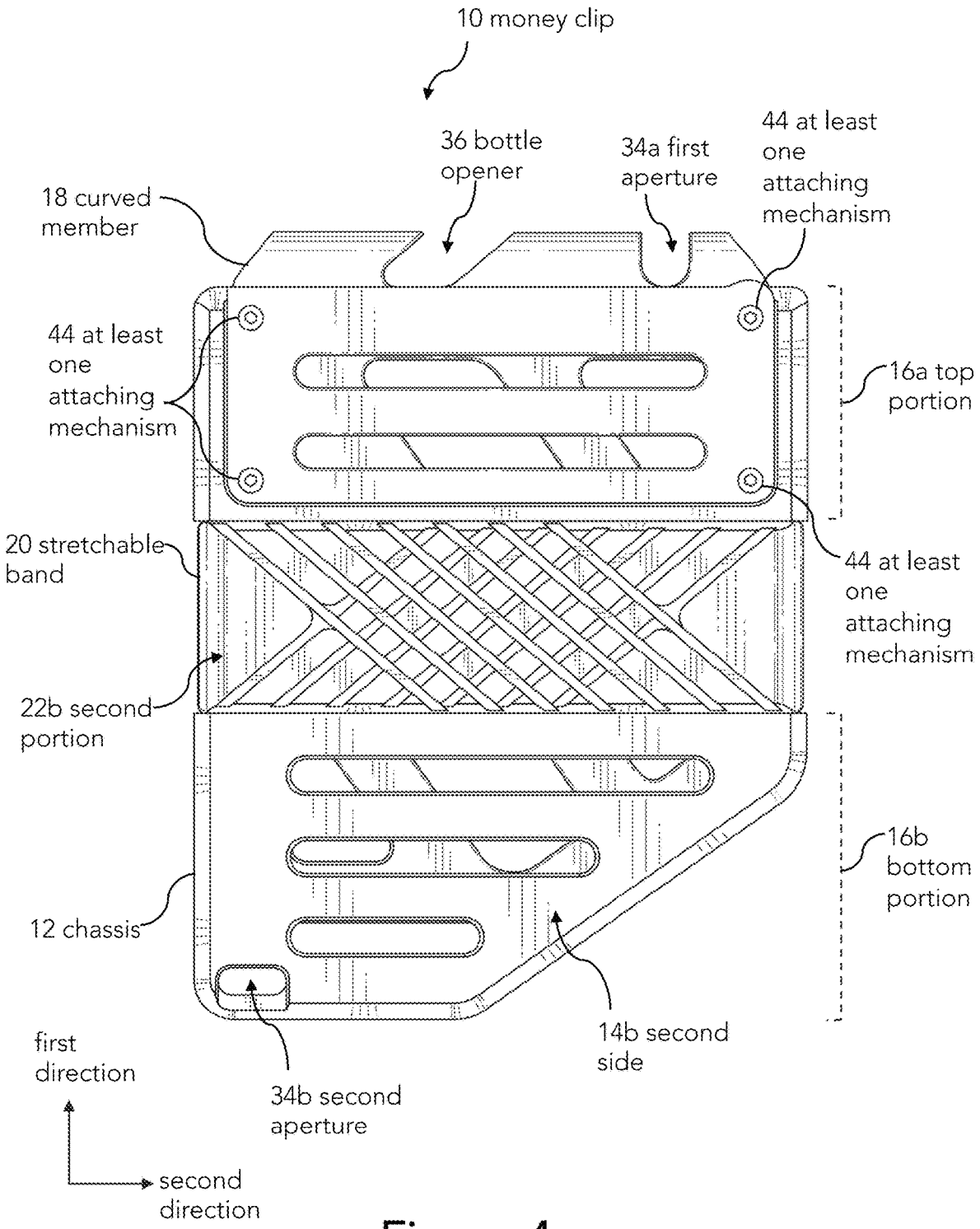
FIGS. 4 and 5 illustrate back views of a money clip, according to some embodiments.
Figure 5:
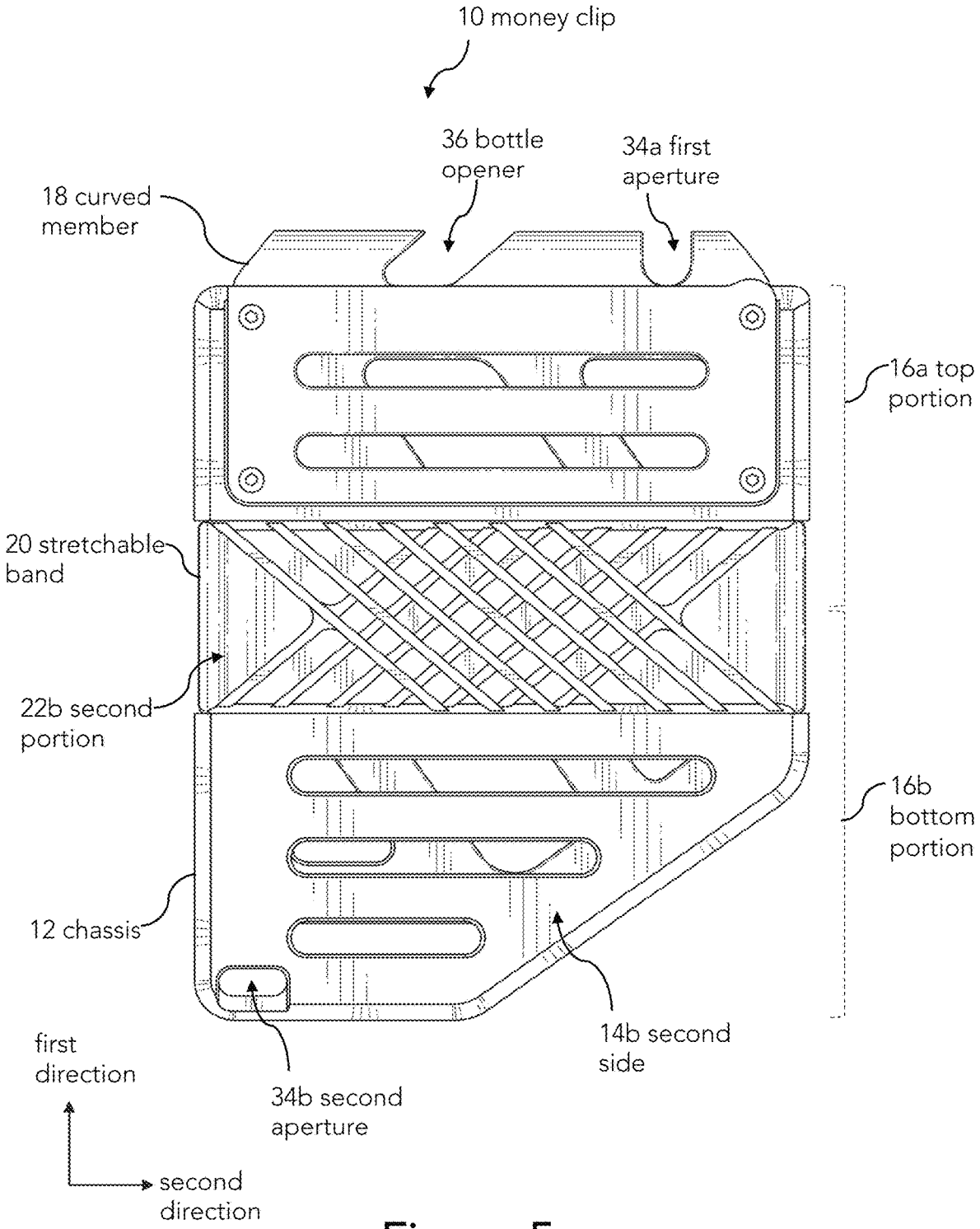

Turning now to FIG. 3, a front view of the money clip 10 is shown. In some embodiments, the chassis 12 defines a first side 14*a*, as shown in FIG. 3, and a second side 14*b* located opposite the first side 14*a*, which is shown in FIGS. 4 and 5. The chassis 12 may also define a top portion 16*a* and a bottom portion 16*b* located opposite the top portion 16*a*. The top and bottom portions 16*a*, 16*b* will be discussed in greater detail with reference to FIGS. 4 and 5. In some embodiments, the stretchable band 20 is configured to wrap around the chassis 12. The stretchable band 20 may comprise a first portion 22*a* located between the first side 14*a* of the chassis 12 and the curved member 18. As shown in FIGS. 4 and 5, the stretchable band 20 may also comprise a second portion 22*b* located on the second side 14*b* of the chassis 12.

FIG. 3 also illustrates that, in some embodiments, the chassis 12 defines a first edge 28*a* and a second edge 28*b* located opposite the first edge 28*a*. Each of the first edge 28*a* and the second edge 28*b* may be configured to extend between the top portion 16*a* and the bottom portion 16*b*. In some embodiments, the stretchable band 20 is configured to wrap around the chassis 12 such that it contacts at least one of the first side 14*a*, the second side 14*b*, the first edge 28*a*, and the second edge 28*b*. The chassis 12 may further define a third edge 28*c* configured to extend from a bottom portion of the first edge 28*a* to a bottom edge 28*d* of the chassis 12, as demonstrated in FIG. 3. As also demonstrated in FIG. 3, the first edge 28*a* may define a length less than the second edge 28*b*. In some embodiments, the chassis 12 also includes a top edge 28*e* located opposite the bottom edge 28*d*, wherein the top edge 28*e* is configured to extend between the first edge 28*a* and the second edge 28*b*, and the bottom edge 28*d* is configured to extend between the third edge 28*c* and the second edge 28*b*.

At least one of the first edge 28*a*, the second edge 28*b*, the third edge 28*c*, the bottom edge 28*d*, and the top edge 28*e* may define a beveled edge. In some embodiments, a beveled edge(s) not only elevates the aesthetic appearance of the money clip 10, but also allows the money clip 10 to be stored more easily. For example, if a user is trying to fit the money clip 10 into a tight pocket, like a clothing pocket, bag pocket, or the like, the beveled edge(s) may help facilitate easier movement of the money clip 10 than would be possible with blunt edge(s). The money clip 10 comprising beveled edge(s) on the chassis 12 may also be more comfortable to hold than a money clip comprising blunt edge(s) on a chassis.

As suggested by the directional indicator in FIG. 3, in some embodiments the first edge 28*a* and the second edge 28*b* are configured to extend along a first direction, while the bottom edge 28*d* and the top edge 28*e* are configured to extend along a second direction perpendicular to the first direction. The stretchable band 20 may also be configured to extend along the second direction. The direction of the third edge 28*c* will be discussed with reference to FIG. 6.

FIGS. 3-5 show that the money clip 10 may include a first aperture 34*a* located on the curved member 18 adjacent the top portion 16*a* of the chassis 12. The money clip 10 may also include a second aperture 34*b* located on the chassis 12 adjacent the bottom portion 16*b*. The second aperture 34*b* may also be referred to as a bottom aperture. In some embodiments, the first aperture 34*a* and the second aperture 34*b* are configured to receive at least one attaching member. The attaching member may comprise at least one of a keyring, a lanyard, a clip, a tether, or other similar mechanism. For example, a user may desire to attach a set of keys to the first aperture 34*a* and a carabiner (or other clip-type mechanism) to the second aperture 34*b*, in order to couple the money clip 10 to a belt loop, a bag handle, etc. The second aperture 34*b* may be configured to extend along the second direction, like the stretchable band 20, top edge 28*e*, and bottom edge 28*d*.

The second aperture 34*b* may define a first side located adjacent the first side 14*a* of the chassis 12 and a second side located adjacent the second side 14*b* of the chassis 12. As such, the first side of the second aperture 34*b* may be visible in FIG. 3, while the second side of the second aperture 34*b* may be visible in FIGS. 4 and 5. In some embodiments, the second side of the second aperture 34*b* comprises a beveled edge similar to the beveled edges discussed above. In contrast, the first side of the second aperture 34*b* may not comprise a beveled edge. In some embodiments, the difference in sides of the second aperture 34*b* is a result of the machining process of the chassis 12. The difference in sides may also make it easier for a user to couple a keyring, or other similar type of mechanism, to the second aperture 34*b*. For example, if both sides of the second aperture 34*b* comprised beveled edges, the second aperture 34*b* would have a thicker bottom portion and it would likely be more difficult to attach a keyring (or similar mechanism) to the second aperture 34*b*. The non-beveled first side of the second aperture 34*b* may provide a blunt edge to use as leverage to open a keyring, where the beveled second side may not assist a user in opening a keyring, as the beveled second side may slope downward and make it more difficult to open the keyring (or similar mechanism).

FIGS. 3-5 also illustrate that, in some embodiments, the money clip 10 comprises a bottle opener 36 located on the curved member 18 adjacent the top portion 16*a* of the chassis 12. The bottle opener 36 may be located adjacent the first aperture 34*a*, as illustrated in the Figures. In some embodiments, the bottle opener 36 defines an angled aperture configured to receive at least a portion of a bottle cap. The bottle opener 36 and the first aperture 34*a* are shown in greater detail in FIG. 11, and will be discussed further with reference therein.

FIGS. 4 and 5 illustrate back views of the money clip 10, including the second side 14*b* of the chassis 12. In some embodiments, as illustrated in FIGS. 4 and 5, the curved member 18 is mechanically coupled to the second side 14*b* of the chassis 12 adjacent the top portion 16*a* of the chassis 12. The curved member 18 may be mechanically coupled via at least one attaching mechanism 44, as indicated in FIG. 4. In some embodiments, the at least one attaching mechanism 44 comprises at least one screw, bolt, or similar attaching mechanism. The at least one attaching mechanism 44 may comprise four total attaching mechanisms. In some embodiments, each of the at least one attaching mechanism 44 comprises a stainless steel bolt. The at least one attaching mechanism 44 may comprise a different type of metal, or a non-metallic material of sufficient strength and durability to couple the curved member 18 to the chassis 12.

Figure 9:
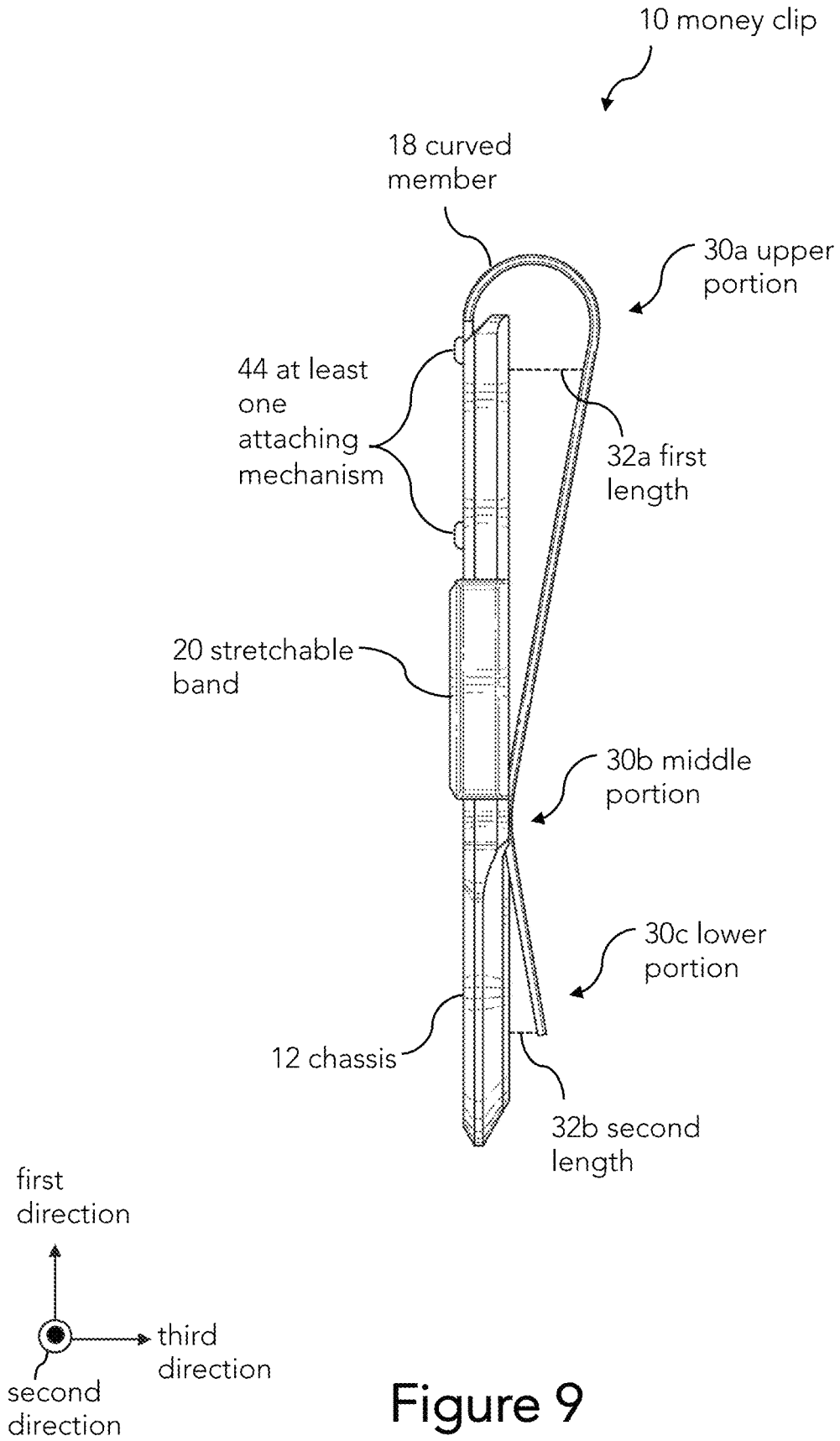

The curved member 18 may be configured to curve around the top portion 16*a* to the first side 14*a* of the chassis 12 and terminate adjacent the bottom portion 16*b*, as illustrated in FIGS. 9, 10A, and 10B. It should be noted that the "top portion 16*a*" and the "bottom portion 16*b*" may be defined broadly, in terms of how much of the chassis 12 defines either the top portion 16*a* or the bottom portion 16*b*. For example, as shown in FIG. 4, the top portion 16*a* may comprise a portion of the chassis 12 located above the stretchable band 20, while the bottom portion 16*b* may comprise a portion of the chassis 12 located below the stretchable band 20. As shown in FIG. 5, the top portion 16*a* may comprise about half of an area of the chassis 12 covered by the stretchable band 20, as well as the portion of the chassis 12 located above the stretchable band 20. Similarly, the bottom portion 16*b* may comprise the other approximately half of the stretchable band 20 and the portion of the chassis 12 located below the stretchable band 20. As shown in FIG. 5, the top portion 16*a* and the bottom portion 16*b* may define unequal portions of the chassis 12, in terms of length and/or width. In some embodiments, the top portion 16*a* and the bottom portion 16*b* comprise substantially equal lengths of the chassis 12. Either the top portion 16*a* or the bottom portion 16*b* may include substantially an entire portion of the chassis 12 covered by the stretchable band 20.

Figure 6:
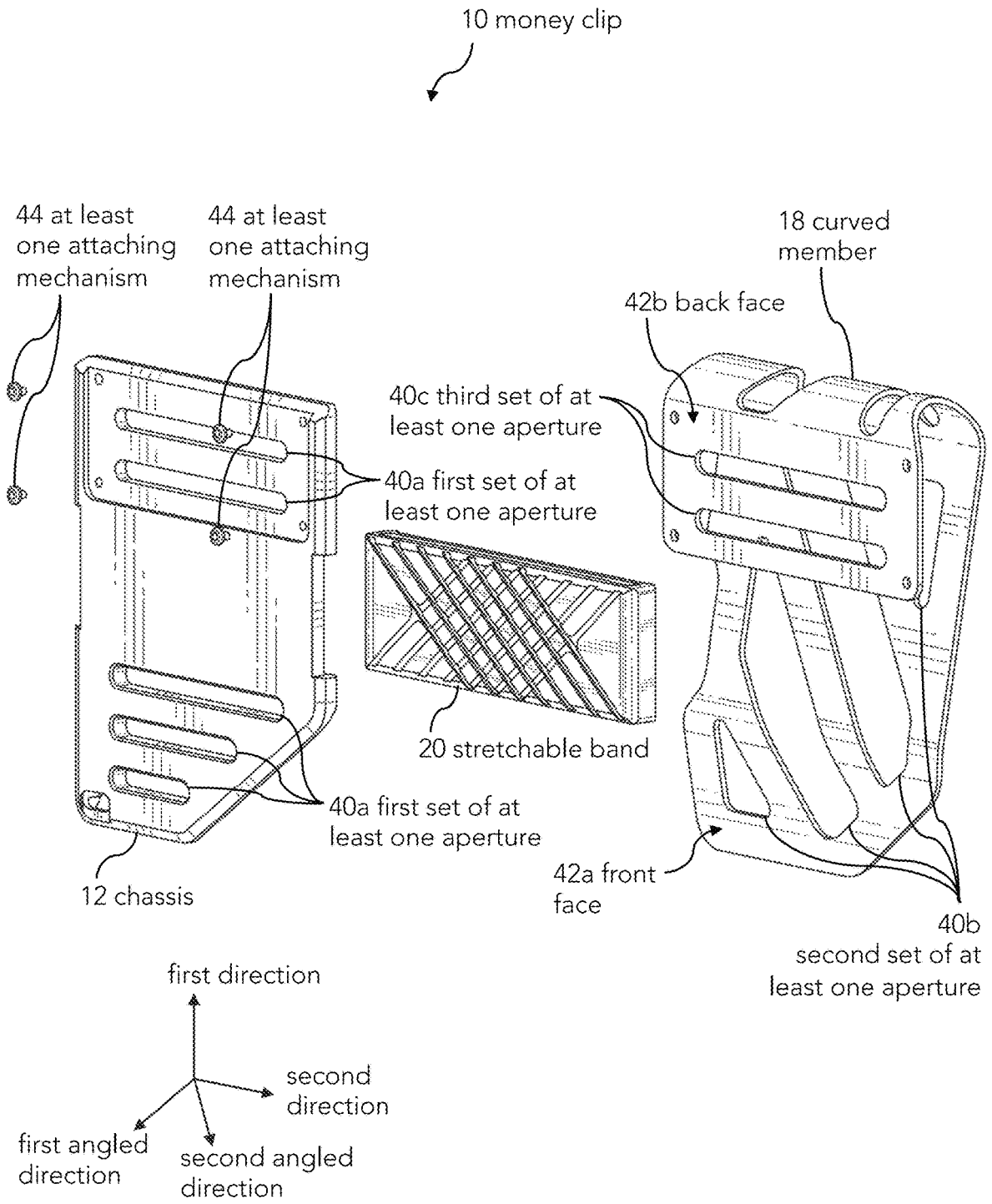
FIG. 6 illustrates an exploded view of a money clip, according to some embodiments.

FIG. 6 illustrates an exploded view of the money clip 10, according to some embodiments. As previously discussed, the money clip 10 may comprise a chassis 12, a stretchable band 20 configured to wrap around the chassis 12, and a curved member 18 configured to couple to, and curve around a top portion 16*a* of, the chassis 12. The money clip 10 may also comprise at least one attaching mechanism 44 configured to couple the curved member 18 to the chassis 12. The chassis 12 may comprise indented edges, for example the first edge 28*a* and second edge 28*b*, where the indents are configured to receive the stretchable band 20 and facilitate a substantially smooth and even perimeter of the chassis 12.

FIG. 6 also includes multiple sets of at least one aperture. In some embodiments, a first set of at least one aperture 40*a* is located on the chassis 12, as shown in FIG. 6. A second set of at least one aperture 40*b* may be located on a front face 42*a* of the curved member 18, and a third set of at least one aperture 40*c* may be located on a back face 42*b* of the curved member 18. In some embodiments, the front face 42*a* of the curved member 18 is located adjacent the first side 14*a* of the chassis 12, while the back face 42*b* is located opposite the front face 42*a* and is configured to couple to the second side 14*b* of the chassis 12.

As previously discussed, the chassis 12 may be configured to extend along a first direction and the stretchable band 20 may be configured to wrap around the chassis 12 along a second direction perpendicular to the first direction. Like the stretchable band 20, the first set of at least one aperture 40*a* and the third set of at least one aperture 40*c* may be configured to extend along the second direction. The third set of at least one aperture 40*c* may be substantially aligned with at least a portion of the first set of at least one aperture 40*a*. Specifically, in some embodiments, the portion of the first set 40*a* located in the top portion 16*a* of the chassis 12 is substantially aligned with the third set of at least one aperture 40*c*. In some embodiments, the third edge 28*c* of the chassis 12 (shown in FIG. 3), is configured to extend along a first angled direction that is not perpendicular to the first direction. The second set of at least one aperture 40*b* may be configured to extend along a second angled direction that is perpendicular to the first angled direction. In some embodiments, the second set of at least one aperture 40*b* is configured to extend along a second angled direction, rather than the second direction like the first set 40*a* and third set 40*c*, in order to offset the apertures of the first set 40*a* and second set 40*b*, and reduce the risk of a personal card(s) and/or paper bill(s) falling and/or being taken out of the money clip 10.

The first set of at least one aperture 40*a* may comprise a first aperture located on the bottom portion 16*b* of the chassis 12, a second aperture located on the bottom portion 16*b*, and a third aperture located on the bottom portion 16*b*. In some embodiments, the first aperture defines a first length, the second aperture defines a second length, and the third aperture defines a third length, wherein the third length is less than the first length and the second length, and wherein the second length is less than the first length. Stated in terms of the Figures, the first aperture may define the aperture located adjacent the stretchable band 20 while the third aperture may define the aperture located adjacent the bottom edge 28*d* of the chassis 12, and the second aperture may define the middle aperture between the first and third apertures. The first set of at least one aperture 40*a* may further comprise a fourth aperture located on the top portion 16*a* of the chassis 12 and a fifth aperture located on the top portion 16*a*, wherein the fourth aperture may define a fourth length and the fifth aperture may define a fifth length. In some embodiments, the fourth length and the fifth length are substantially equal to the first length. Each of the first aperture, second aperture, third aperture, fourth aperture, and fifth aperture may be configured to extend along the second direction.

The third set of at least one aperture 40*c* may comprise a first aperture extending along the second direction and a second aperture extending along the second direction. In some embodiments, the first aperture and second aperture of the third set 40*c* are configured to substantially align with the fourth aperture and the fifth aperture of the first set 40*a*. The first set of at least one aperture 40*a* may comprise four total apertures, with two substantially triangle-shaped apertures, as shown in FIGS. 3 and 6, and two other apertures extending along the second angled direction.

In some embodiments, at least one aperture of at least one of the first set 40*a*, the second set 40*b*, and the third set 40*c* is configured to allow a user to view at least one of at least one personal card 24 and at least one paper bill 26 coupled to the money clip 10, as shown in FIGS. 7 and 8. FIG. 7 illustrates a front view of the money clip 10 coupled to at least one paper bill 26. As previously discussed, the at least one paper bill 26 may be configured to be received and secured between the curved member 18 and the first side 14*a* of the chassis 12. The money clip 10 may be sized and configured to hold a plurality of paper bills, as shown in FIG. 7. As mentioned throughout this disclosure, in some embodiments, the money clip 10 comprises materials arranged and configured to bend, flex, etc. to accommodate different amounts of paper bills and/or personal cards, while retaining its original shape.

FIG. 8 illustrates a back view of the money clip 10 with at least one personal card 24 coupled to the money clip 10 between the stretchable band 20 and the second side 14*b* of the chassis 12. Similar to the at least one paper bill 26, the money clip 10 may be configured to receive and secure a plurality of personal cards. Like the curved member 18, the stretchable band 20 may be configured to stretch to accommodate a plurality of personal cards while retaining its original shape. Accordingly, the money clip 10 may be configured to hold, for example, 10 personal cards and/or 50 paper bills with a substantially equal amount of security as a single personal card and/or a single paper bill. It should be noted that though FIG. 7 illustrates at least one paper bill 26, and FIG. 8 illustrates at least one personal card 24, the money clip 10 may be configured to hold at least one paper bill 26, at least one personal card 24, or a combination of both on either side 14*a*, 14*b* of the chassis 12. This may allow a user of the money clip 10 to organize their items in a number of ways; for example, with paper bills on one side of the chassis 12 and personal cards on the other, small bills on one side of the chassis 12 and large bills on the other, and/or more frequently used bills and/or cards on one side of the chassis 12 and less frequently used bills and/or cards on the other.

FIGS. 9, 10A, and 10B illustrate side views of the money clip 10. As previously mentioned, the chassis 12 may be configured to extend along a first direction and the stretchable band 20 may be configured to wrap around the chassis 12 along a second direction perpendicular to the first direction. In some embodiments, at least a portion of the curved member 18 is offset from the chassis 12 along a third direction that is perpendicular to the first direction and the second direction, as shown in FIGS. 9, 10A, and 10B. The stretchable band 20 may be configured to extend along the third direction from the second side 14*b* of the chassis 12 in order to receive at least one personal card 24 and/or at least one paper bill 26, thereby retaining at least one personal card 24 and/or at least one paper bill 26 between the stretchable band 20 and the second side 14*b* of the chassis 12. FIGS. 9, 10A, and 10B also illustrate that the curved member 18 may comprise an upper portion 30*a*, a middle portion 30*b*, and a lower portion 30*c*.

It should be noted that, similar to the top portion 16*a* and bottom portion 16*b* of the chassis 12, the upper portion 30*a*, middle portion 30*b*, and lower portion 30*c* of the curved member 18 may be defined broadly. In some embodiments, as illustrated in FIGS. 9, 10A, and 10B, the middle portion 30*b* defines a portion of the curved member 18 that is configured to contact (i.e., the "contacting portion"), or substantially close to contact (e.g., spaced only 1-2 mm away from) the chassis 12. The upper portion 30*a* may comprise the portion of the curved member 18 located above the middle portion 30*b*, adjacent the top portion 16*a* of the chassis 12. The lower portion 30*c* may comprise the portion of the curved member 18 located below the middle portion 30*b*, adjacent the bottom portion 16*b* of the chassis 12. In some embodiments, the middle portion 30*b* defines the contacting portion, as well as a portion of the curved member 18 extending at least one of above and below the contacting portion.

The upper portion 30*a*, the middle portion 30*b*, and the lower portion 30*c* may define discrete fractions of the curved member 18. For example, the upper portion 30*a* may comprise substantially ½ of a total length of the curved member 18, while the middle portion 30*b* and the lower portion 30*c* may each comprise substantially ¼ of the total length of the curved member 18. In another example, the upper portion 30*a* may comprise substantially ¾ of the total length of the curved member 18, the middle portion 30*b* may comprise substantially 1/16 of the total length, and the lower portion 30*c* may comprise substantially 3/16 of the total length. In yet another example, the upper portion 30*a* may comprise substantially ½ of the total length of the curved member 18, the middle portion 30*b* may comprise substantially ⅛ of the total length, and the lower portion 30*c* may comprise substantially ⅜ of the total length. A person having ordinary skill in the art will recognize that any number of possible fractions may be suitable for defining the relative lengths of each of the upper portion 30*a*, the middle portion 30*b*, and the lower portion 30*c*.

In some embodiments, the upper portion 30*a* is physically spaced from the chassis 12 by a first length 32*a* and the lower portion 30*c* is physically spaced from the chassis 12 by a second length 32*b*, as demonstrated in FIG. 9. The middle portion 30*b* may be physically spaced from the chassis 12 by a third length that is less than the first length 32*a* and the second length 32*b*. In some embodiments, as illustrated in FIGS. 9 and 10A and mentioned above, the middle portion 30*b* is configured to contact the first side 14*a* of the chassis 12. FIG. 9 also shows that the second length 32*b* may be less than the first length 32*a*. In some embodiments, for example when the money clip 10 is coupled to a large quantity of at least one personal card 24 and/or at least one paper bill 26, at least one of the second length 32*b* and the third length may be greater than the first length 32*a*. The first length 32*a*, second length 32*b*, and third length will be discussed further with reference to FIG. 10B.

In some embodiments, the upper portion 30*a* of the curved member 18 is physically spaced along the first direction from the top edge 28*e* of the chassis 12 and along the third direction from the first side 14*a* of the chassis 12. The lower portion 30*c* may also be physically spaced along the third direction from the first side 14*a* of the chassis 12. In some embodiments, as illustrated by FIGS. 10A and 10B, the middle portion 30*b* is configured to move along the third direction. It should be noted that the term "move" may be replaced with "bend," "flex," "stretch," "expand," or any other similar term to convey how the middle portion 30*b* changes distance from the chassis 12 in order to receive at least one of at least one personal card 24 and at least one paper bill 26, thereby retaining the at least one of at least one personal card 24 and at least one paper bill 26 between the curved member 18 and the chassis 12.

The movement of the middle portion 30*b* shown in FIGS. 10A and 10B illustrates that, in some embodiments, the third length (i.e., the length between the middle portion 30*b* and the chassis 12) is less than the first length 32*a* (i.e., the length between the upper portion 30*a* and the chassis 12) and the second length 32*b* (i.e., the length between the lower portion 30*c* and the chassis 12). The money clip 10 may be arranged and configured such that the middle portion 30*b* is configured to directly contact the at least one of at least one personal card 24 and at least one paper bill 26, while at least a portion of the upper portion 30*a* and at least a portion of the lower portion 30*c* is configured to not contact the at least one of at least one personal card 24 and at least one paper bill 26. Such an arrangement may reduce wear-and-tear, prevent unnecessary bending, and generally maintain the physical quality of at least one of the at least one personal card 24 and at least one paper bill 26. The curved member 18 may be arranged and configured such that the middle portion 30*b* has an extensive range of motion along the third direction, in order to accommodate a single paper bill and/or personal card, or a large quantity of paper bills and/or personal cards.

Figure 11:
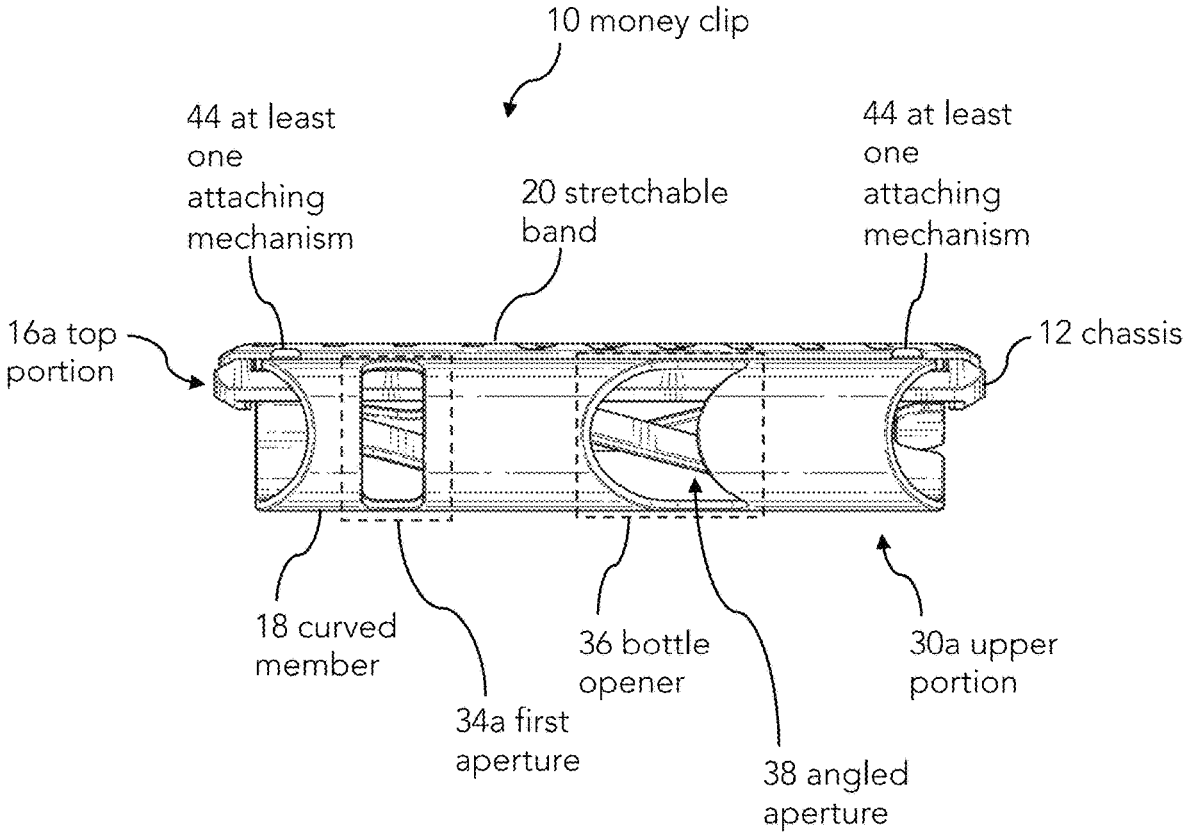
FIG. 11 illustrates a top view of a money clip, according to some embodiments.

Turning now to FIG. 11, a top view of the money clip 10 is shown, including the first aperture 34*a* and the bottle opener 36 located on the upper portion 30*a* of the curved member 18. As mentioned with respect to FIG. 3, the bottle opener 36 may define an angled aperture 38. The angled aperture 38 is shown in FIG. 11 as defining a shape similar to a crescent moon, with wider top and bottom portions. In some embodiments, the bottle opener 36 is configured to receive a bottle cap such that a bottom edge of the bottle cap fits under a right side (i.e., the convex portion) of the angled aperture 38, and the money clip 10 is moved away from the bottle so that the leverage of the convex portion under the bottom edge pulls off the bottle cap. In contrast to the bottle opener 36 defining an angled aperture 38, the first aperture 34*a* may define an even, symmetrical, elongated oval shape. In some embodiments, the first aperture 34*a* defines a circular shape, a rectangular shape, or any number of suitable shapes. The first aperture 34*a* may be sized and configured to receive at least one keyring, clip, lanyard, tether, or other similar mechanism, as discussed with reference to FIGS. 3-5. Though shown in the Figures with only the first aperture 34*a* and the bottle opener 36, the upper portion 30*a* of the curved member 18 may comprise at least one additional aperture. In some embodiments, the bottle opener 36 and the first aperture 34*a* are sized and configured to minimize exposure of the at least one personal card 24 and/or at least one paper bill 26 to risk of falling out of, or being removed from, the money clip 10.

In some embodiments, as previously discussed in this disclosure, the chassis 12 comprises aluminum and the curved member 18 comprises titanium. More specifically, the chassis 12 may comprise CNC-machined, 6061 aerospace aluminum, and the curved member 18 may comprise a titanium alloy heat-treated to prevent cracking while retaining flexibility and shape memory. As such, the titanium alloy may be configured so that the curved member 18 is configured to repeatedly flex (or bend, move, extend, etc.) without losing its shape. In some embodiments, the use of aluminum and titanium materials in the construction of the money clip 10 enables the money clip 10 to serve as a radio frequency identification ("RFID")-blocking money clip 10. For example, if at least one personal card 24 (e.g., an RFID or "chip" card) is inserted with the chip located adjacent the top portion 16*a* of the chassis 12, then the chassis 12 and the curved member 18 may form a metal cage to substantially surround the chip and protect the at least one personal card 24 from malicious RFID reading technology.

The money clip 10 may include a level of customization to suit individual users. In some embodiments, the chassis 12 comprises different possible colors of aluminum. For example, the chassis 12 may comprise gray aluminum, black aluminum, gold aluminum, or any other color. In addition, the stretchable band 20 may comprise different colors such that a user may "mix and match" by choosing from several color options for both the chassis 12 and the stretchable band 20. The curved member 18 may also include different color options.

As indicated in FIGS. 7 and 8, the money clip 10 may be sized larger than at least one personal card 24 and/or at least one paper bill 26, when the at least one paper bill 26 is in a folded position. At least one personal card 24 may include a standard driver's license, other identification card, credit card, gift card, or the like, defining a width of about 3.37 inches, a height of about 2.125 inches, and a thickness of about 1 millimeter. The at least one paper bill 26 may include paper currency from any nation and/or group of nations, in addition to business cards, paper coupons, and other paper items (e.g., grocery list, event ticket, claim check, parking pay stub, etc.). In some embodiments, the money clip 10 defines a length of about 3.85 inches, a width of about 3 inches, and a variable depth/thickness, depending on a quantity of personal cards and/or paper bills coupled to the money clip 10. The money clip 10 alone, without any personal cards and/or paper bills, may define a depth/thickness of about 16.5 millimeters at an upper portion 30*a* of the curved member 18, a depth/thickness of about 10.5 millimeters at a lower portion 30*c* of the curved member 18, and a weight of about 2.8 ounces. The money clip 10 may be configured to hold up to eighty paper bills (e.g., U.S. bills of any dollar amount, folded in half), with fifty bills between the curved member 18 and the chassis 12, and thirty bills between the stretchable band 20 and the chassis 12. The money clip 10 may be configured to hold up to 26 personal cards, with 16 cards between the curved member 18 and the chassis 12, and 10 cards between the stretchable band 20 and the chassis 12. Exact quantities of personal cards and/or paper bills that may be held by the money clip 10 will depend on the individual thickness of each card and/or bill, and the quantities listed here are included as non-limiting examples. In some embodiments, the stretchable band 20 is configured to stretch up to 10 millimeters.

It should be noted that the dimensions of the money clip 10 included in this disclosure are intended to form a non-limiting example. The money clip 10 may be larger than at least one of the listed dimensions. The money clip 10 may be smaller than at least one of the listed dimensions.

Figure 12:
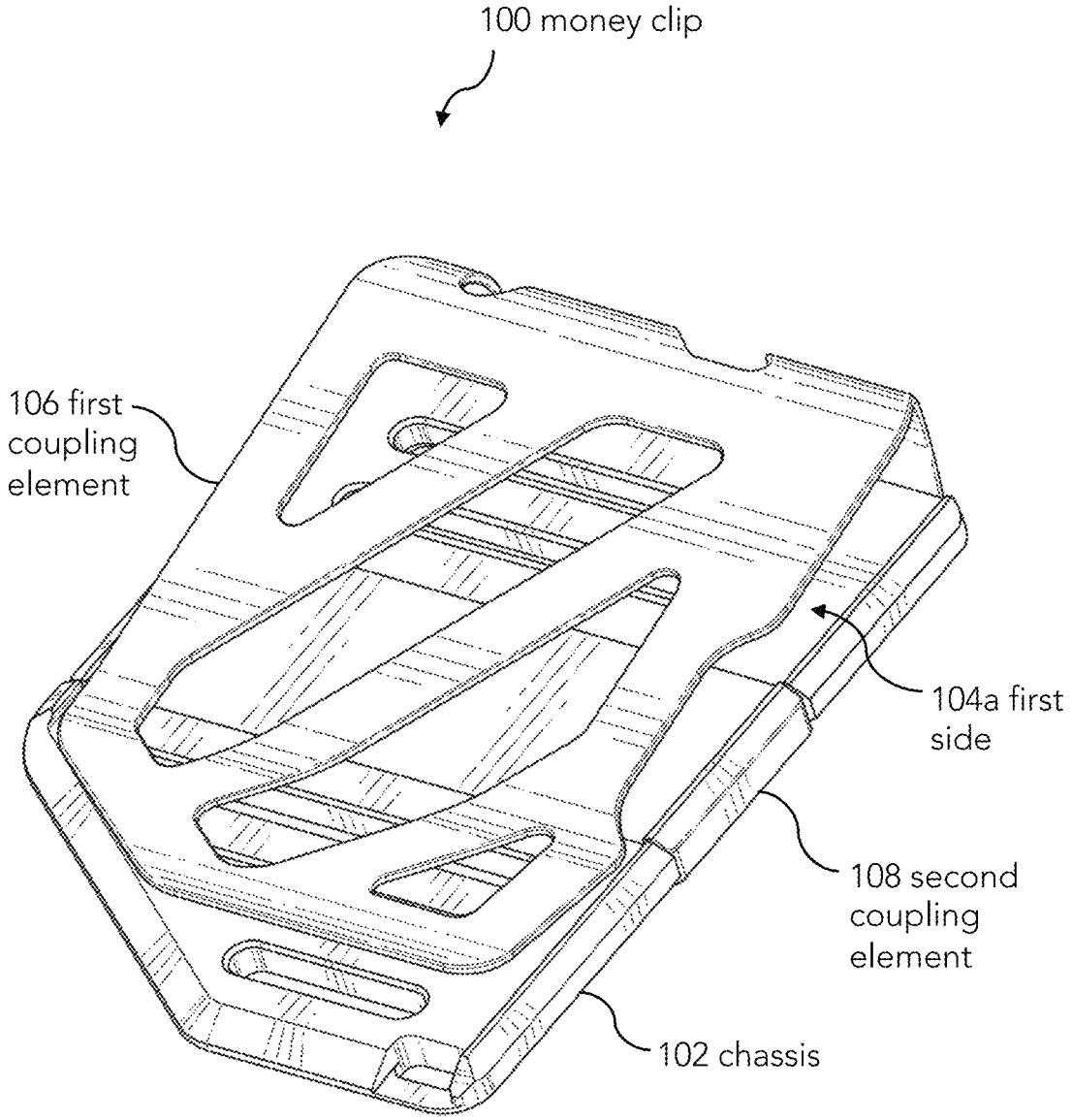
FIG. 12 illustrates a front perspective view of a money clip, according to some embodiments.

FIG. 12 illustrates a front perspective view of a money clip 100. It should be noted that the money clip 100 may be substantially similar to the money clip 10 previously discussed in this disclosure and shown in FIGS. 1-11. For example, the money clip 100 may be comprised of the same materials and may be substantially the same size as the money clip 10. The money clip 100 may also include substantially the same components as the money clip 10.

As indicated in FIG. 12, in some embodiments, the money clip 100 comprises a chassis 102 defining a first side 104*a*, a first coupling element 106 and a second coupling element 108. The first coupling element 106 may be configured to retain a personal effect between the first coupling element 106 and the first side 104*a* of the chassis 102. In some embodiments, the personal effect comprises a personal card (e.g., driver's license, credit card, identification card, or the like), a paper bill (e.g., paper currency, ticket stub, receipt, business card, or the like), and combinations thereof (e.g., both a personal card and a paper bill).

The first coupling element 106 may be configured to overlap the second coupling element 108, such that the first coupling element 106 extends beyond the second coupling element 108 with respect to the chassis 102. For example, as shown in FIG. 12, the first coupling element 106 extends over and beyond the second coupling element 108 along the first side 104*a* of the chassis 102. In some embodiments, the first coupling element 106 is configured to contact the second coupling element 108.

Figure 13:
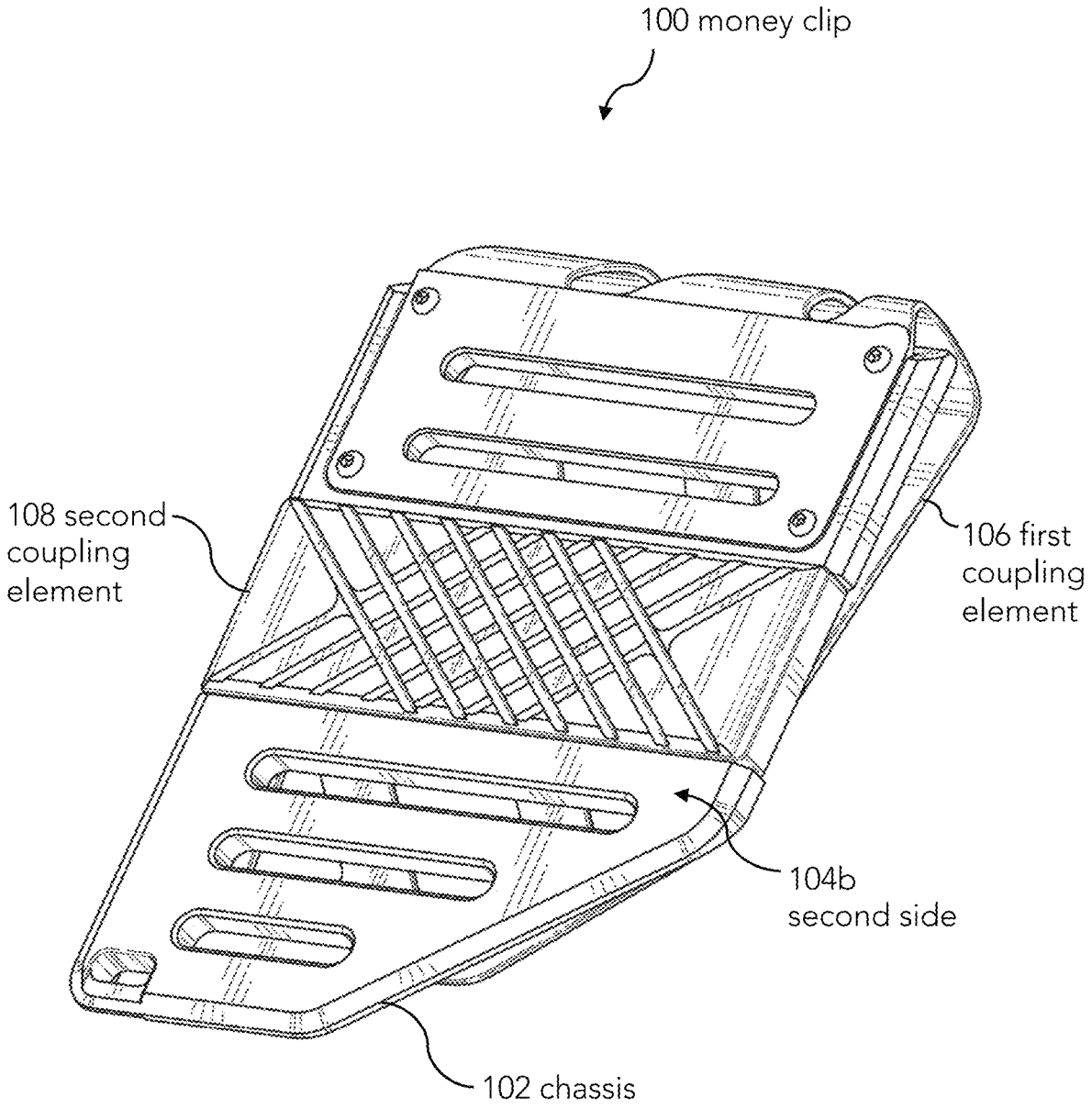
FIG. 13 illustrates a back perspective view of a money clip, according to some embodiments.

FIG. 13 illustrates a back perspective view of the money clip 100. In some embodiments, as shown in FIG. 13, the chassis 102 defines a second side 104*b* located opposite the first side 104*a* shown in FIG. 12. The second coupling element 108 may be configured to retain a personal effect between the second coupling element 108 and the second side 104*b* of the chassis 102. As discussed with reference to FIG. 12, the personal effect may comprise a personal card, a paper bill, and combinations thereof.

In some embodiments, as shown in FIG. 13, the first coupling element 106 is mechanically coupled to the second side 104*b* of the chassis 102. Though not specifically labeled in FIG. 13, the first coupling element 106 may be coupled via at least one attaching mechanism, as previously discussed with reference to the money clip 10 and FIG. 4. The at least one attaching mechanism may comprise at least one bolt, screw, or similar mechanism. As demonstrated in FIG. 13, the first coupling element 106 may be coupled to the second side 104*b* of the chassis 102 with a total of four attaching mechanisms. The first coupling element 106 may be coupled with fewer than four attaching mechanisms. In some embodiments, the first coupling element 106 is coupled with more than four attaching mechanisms. The first coupling element 106 may be coupled to the chassis 102 a different way, such as, for example, via welding, adhesive, or another method. In some embodiments, the first coupling element 106 extends from the second side 104*b* of the chassis 102 to the first side 104*a* of the chassis 102.

Figure 14:
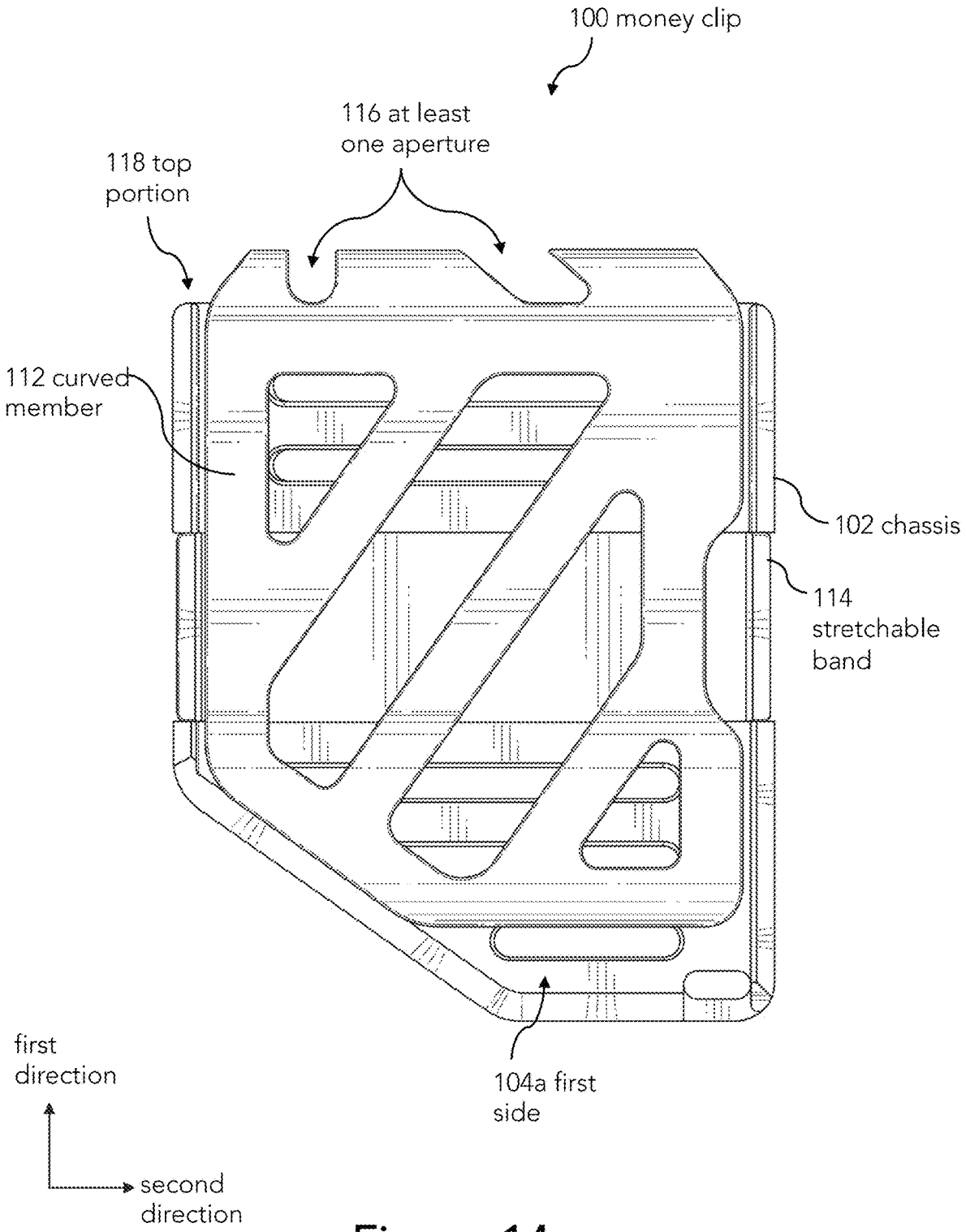
FIG. 14 illustrates a front view of a money clip, according to some embodiments.

FIG. 14 illustrates a front view of the money clip 100. In some embodiments, as shown, the first coupling element 106 comprises a curved member 112 and the second coupling element 108 comprises a stretchable band 114. It should be noted that the curved member 112 may be substantially similar to the curved member 18 previously discussed in this disclosure. Further, the stretchable band 114 may be substantially similar to the stretchable band 20 previously discussed in this disclosure. In some embodiments, the curved member 112 extends from the first side 104*a* of the chassis 102 to the second side 104*b* of the chassis 102. The stretchable band 114 may be configured to wrap around the chassis 102. In addition, the stretchable band 114 may be configured to provide friction to enable the money clip 100 to retain the personal effect between the curved member 112 and the first side 104*a* of the chassis 102.

In some embodiments, as shown in FIG. 14, the money clip 100 includes at least one aperture 116 located on the first coupling element 106 (i.e., the curved member 112) adjacent the top portion 118 of the chassis 102. The at least one aperture 116 may comprise two apertures, as demonstrated in FIG. 14. In some embodiments, the at least one aperture 116 includes more than two apertures. The at least one aperture 116 may include a single aperture. In some embodiments, the at least one aperture 116 is configured to couple to an attaching member such as, but not limited to, a tether, lanyard, strap, carabiner, clip, keyring, or similar member to enable a user to carry the money clip 100 and/or attach the money clip 100 to an external element (e.g., a bag strap, belt loop, etc.).

Figure 15:
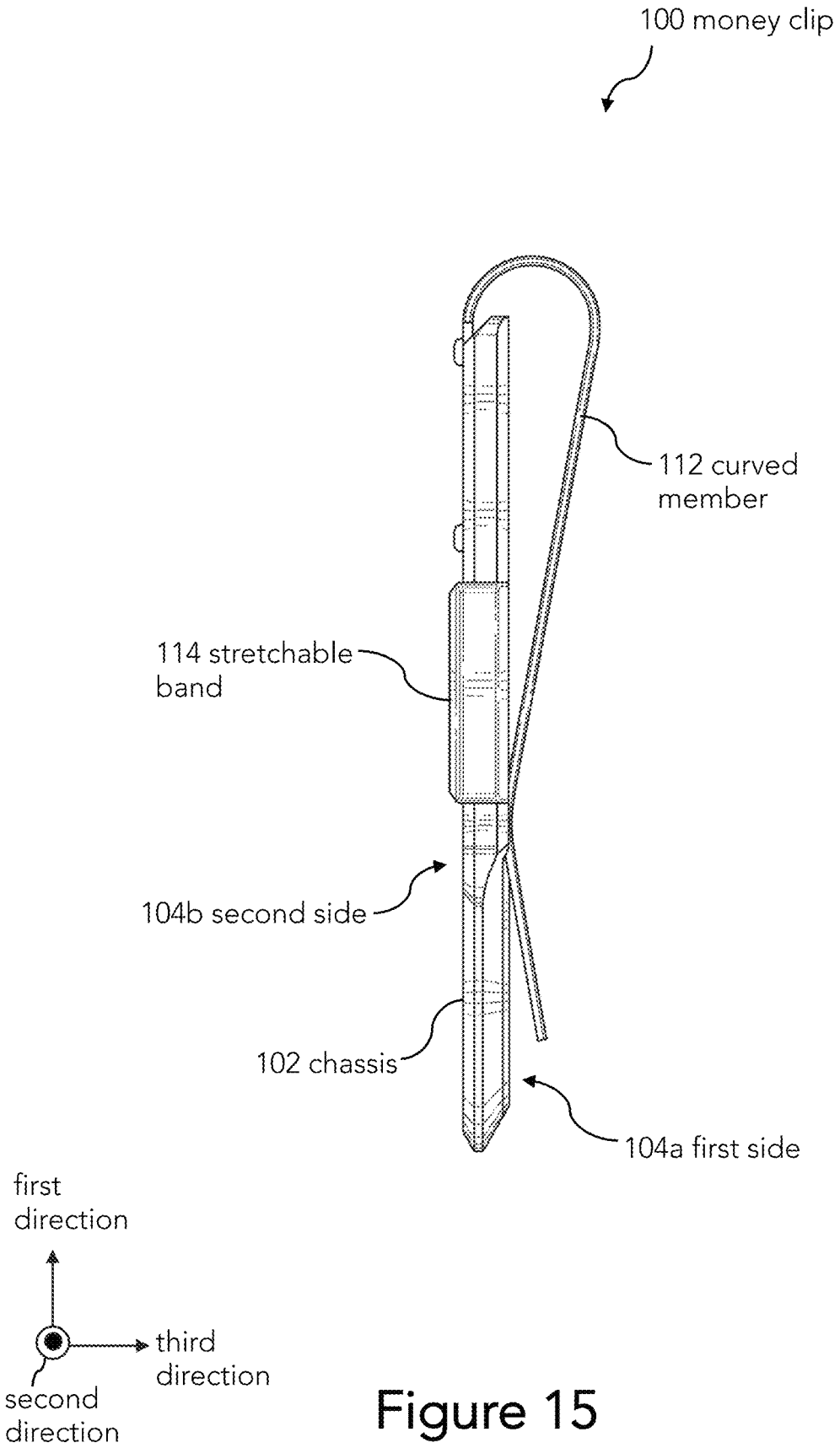
FIG. 15 illustrates a side view of a money clip, according to some embodiments.

FIG. 14 also includes a directional indicator showing a first direction and a second direction. In some embodiments, the chassis 102 extends along the first direction and the stretchable band 114 wraps around the chassis 102 along the second direction. The second direction may be perpendicular to the first direction, as indicated. FIG. 15 also includes a directional indicator and introduces a third direction, which may be perpendicular to both the first direction and the second direction. In some embodiments, at least a portion of the curved member 112 is offset from the chassis 102 along the third direction, as shown in FIG. 15.

Each of the curved member 112 and the stretchable band 114 may configured to flex along the third direction. For example, in some embodiments, the curved member 112 is configured to flex along the third direction to thereby couple the personal effect against the first side 104*a* of the chassis 102. This concept was previously discussed in this disclosure with regard to the money clip 10 and FIGS. 10A and 10B. Similarly, the stretchable band 114 may be configured to flex along the third direction to thereby couple the personal effect against the second side 104*b* of the chassis 102. It should be noted that the "third direction" may be interpreted as both "right" and "left" or "east" and "west." Accordingly, though the curved member 112 and the stretchable band 114 may flex "opposite" of one another (i.e., the curved member 112 flexes to the right and the stretchable band 114 flexes to the left with respect to the page and the orientation of FIG. 15), both are flexing "along the third direction." In addition, the term "flex" (or "flexes," "flexing," etc.) may also mean "move," "extend," "stretch," "expand," or any other similar term.

Figure 16:
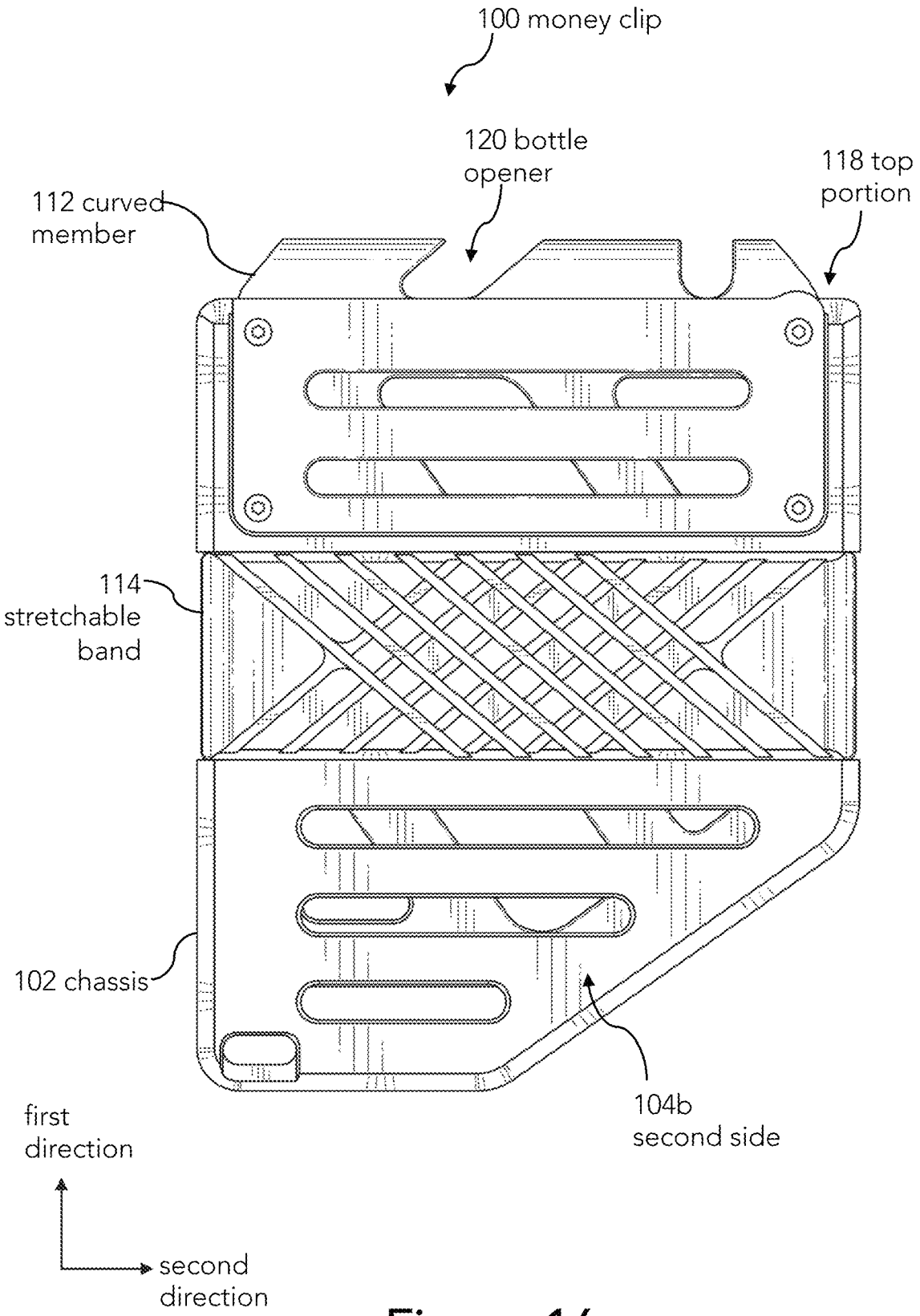
FIG. 16 illustrates a back view of a money clip, according to some embodiments.

FIG. 16 illustrates a back view of the money clip 100, including the second side 104*b* of the chassis 102, the curved member 112, and the stretchable band 114. In some embodiments, as shown in FIG. 16, the money clip 100 includes a bottle opener 120 located on the curved member 112 adjacent a top portion 118 of the chassis 102. The bottle opener 120 may be considered one of the at least one aperture 116 shown in, and discussed with reference to, FIG. 14. In some embodiments, the bottle opener 120 defines an angled aperture configured to receive at least a portion of a bottle cap to thereby remove the bottle cap. It should be noted that the bottle opener 120 may be substantially similar to the bottle opener 36 located on the money clip 10 previously discussed in this disclosure.

Figure 17:
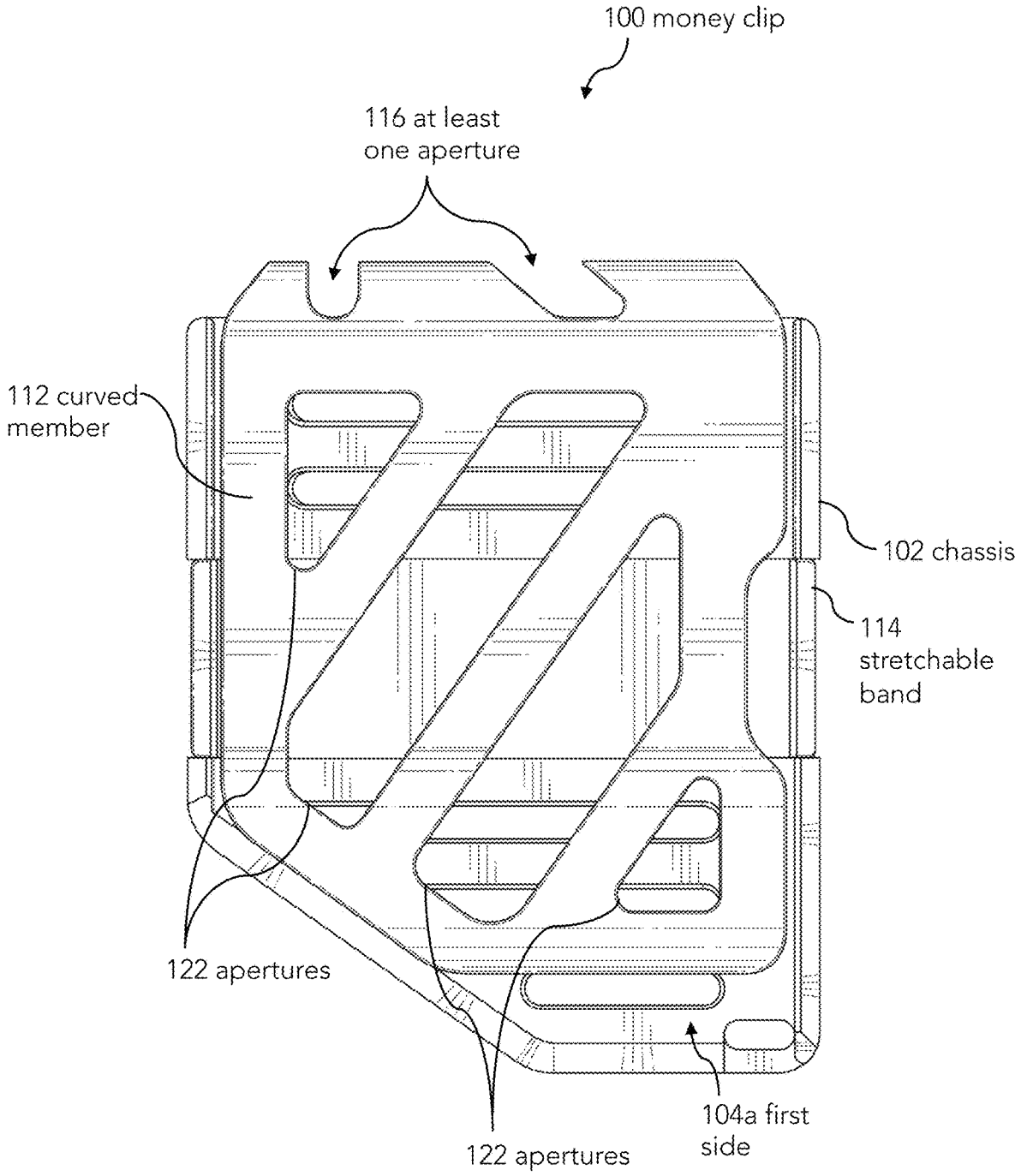
FIG. 17 illustrates a front view of a money clip, according to some embodiments.

In some embodiments, the curved member 112 comprises apertures 122 located adjacent the first side 104*a* of the chassis 102. As shown in FIG. 17, the apertures 122 may comprise four total apertures. The apertures 122 may be substantially similar to the second set of at least one aperture 40*b* shown in, and discussed with reference to, FIGS. 6 and 7. It should be noted that though not shown in the Figures pertaining to the money clip 100, the money clip 100 may include substantially the same apertures (e.g., the first set of at least one aperture 40*a*, the second set of at least one aperture 40*b*, and the third set of at least one aperture 40*c*) as the money clip 10. The apertures 122 may be configured to allow a user of the money clip 100 to view the personal effect(s) coupled between the curved member 112 and the chassis 102. Further, the money clip 100 may also include the first aperture 34*a* and second aperture 34*b* (or "bottom aperture") shown in FIG. 3 and discussed with reference to the money clip 10.

Figure 18:
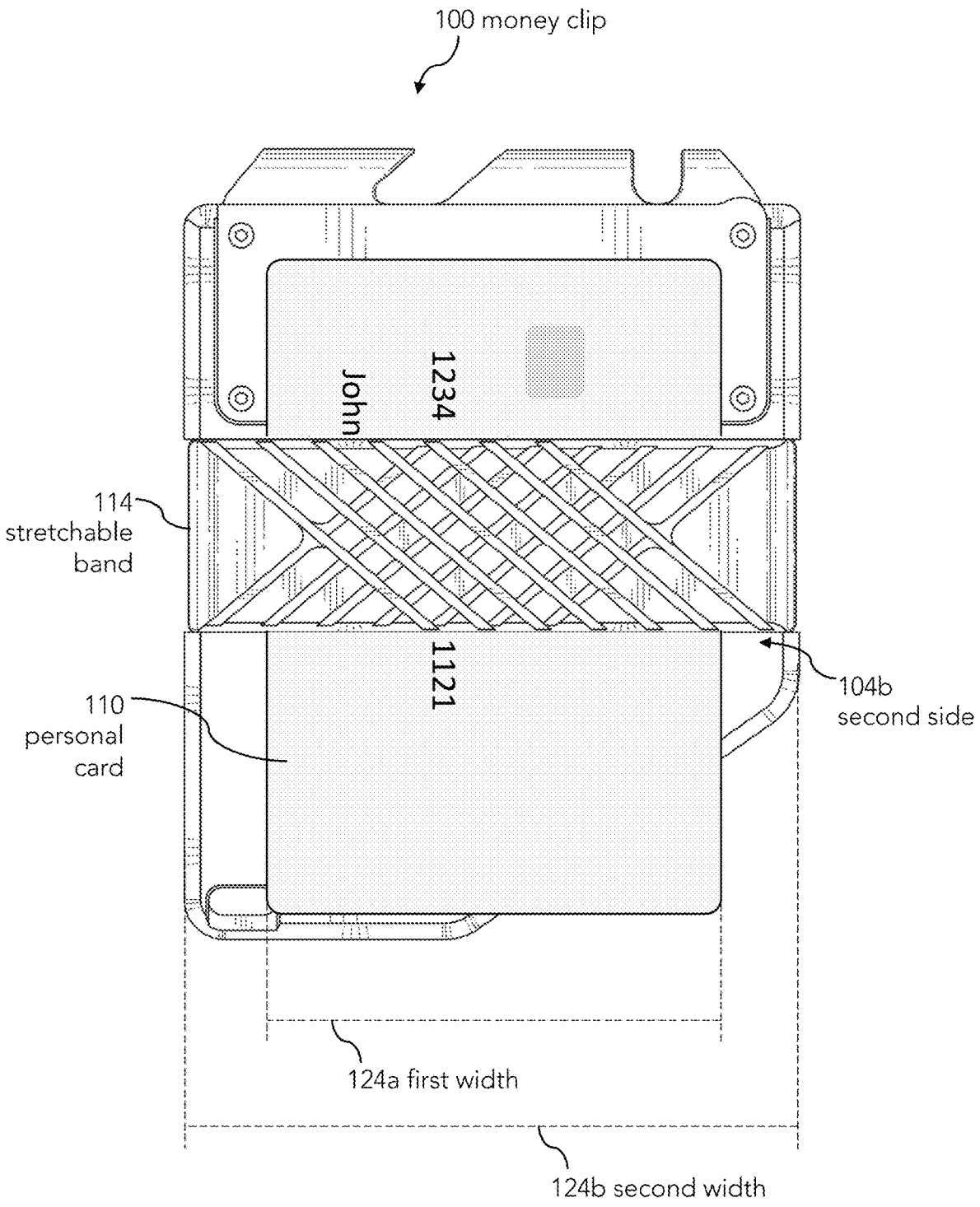
FIG. 18 illustrates a back view of a money clip coupled to a personal card, according to some embodiments.

FIG. 18 illustrates another back view of the money clip 100, similar to FIG. 16. However, FIG. 18 shows a personal card 110 coupled between the stretchable band 114 and the second side 104*b* of the chassis 102. As indicated in FIG. 18, the personal card 110 may define a first width 124*a* and the money clip 100 (e.g., the chassis 102) may define a second width 124*b*. In some embodiments, the second width is larger than the first width, such that the money clip 100 is wider than the personal card 110 (when the personal card 110 is in the "portrait" or "vertical" orientation, as shown in FIG. 18). Constructing the money clip 100 to be wider than a (standard) personal card 110 may help reduce wear and tear on the personal card 110, particularly on the edges of the personal card 110. In some embodiments, the money clip 100 is narrower than the personal card 110. The money clip 100 may define similar dimensions as those listed previously in this disclosure for the money clip 10.

In some embodiments, the chassis 102 comprises aluminum and the first coupling element 106 (i.e., the curved member 112) comprises titanium. More specifically, the chassis 102 may comprise CNC-machined, 6061 aerospace aluminum, and the curved member 112 may comprise a titanium alloy heat-treated to prevent cracking while retaining flexibility and shape memory. As such, the titanium alloy may be configured so that the curved member 112 is configured to repeatedly flex (or bend, move, extend, etc.) while retaining its curved shape.

In some embodiments, the use of aluminum and titanium materials in the construction of the money clip 100 enables the money clip 100 to serve as a radio frequency identification ("RFID")-blocking money clip 100. For example, if at least one personal card 110 (e.g., an RFID or "chip" card) is inserted with the chip located adjacent the top portion 118 of the chassis 102, then the chassis 102 and the curved member 112 may form a metal cage to substantially surround the chip and protect the at least one personal card 110 from malicious RFID reading technology.

The money clip 100 may include a level of customization to suit individual users. In some embodiments, the chassis 102 comprises different possible colors of aluminum. For example, the chassis 102 may comprise gray aluminum, black aluminum, gold aluminum, or any other color. In addition, the stretchable band 114 may comprise different colors such that a user may "mix and match" by choosing from several color options for both the chassis 102 and the stretchable band 114. The curved member 112 may also include different color options. The color options for the curved member 112 may be different from the color options for the chassis 102. In some embodiments, the color options for the curved member 112 and the chassis 102 are the same, such that a user may select the same colors for both components. The color selection for the chassis 102, the stretchable band 114, and the curved member 112 may also be the same, enabling a user to customize a monochromatic money clip 100.

Interpretation

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

The term "about" is used to mean "approximately." For example, the disclosure includes, "At least one personal card 24 may include a standard driver's license, other identification card, credit card, gift card, or the like, defining . . . a thickness of about 1 millimeter." In this context, "about one millimeter" is used to mean "approximately" one millimeter. A range of 0.5 millimeters to 1.5 millimeters falls into an acceptable range and interpretation of "about one millimeters," as used in this disclosure.

The term "substantially" is used to mean "completely" or "nearly completely." For example, the disclosure includes, "Specifically, in some embodiments, the portion of the first set 40*a* located in the top portion 16*a* of the chassis 12 is substantially aligned with the third set of at least one aperture 40*c*." In this context, "substantially aligned" is used to mean that the portion of the first set of at least one aperture 40*a* located in the top portion 16*a* may be "completely" aligned or "nearly completely" aligned with the third set of at least one aperture 40*c*, and fall into the understanding of "substantially" as used in this disclosure. The first set 40*a* and third set 40*c* may be offset from one another by up to 25%, and still be considered "substantially aligned."

The term "element" may be used to mean "a constituent part: such as a distinct part of a composite device." For example, the disclosure makes reference to both a "first coupling element" and a "second coupling element." In this context, the term "element" is used to define each of the "first coupling element" and the "second coupling element" as constituent parts of the money clip.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

What is claimed is:

1. A money clip, comprising:

a chassis defining a first side and a second side located opposite the first side;

a first coupling element coupled to the chassis, the first coupling element configured to retain a first personal effect selected from the group consisting of a personal card, a paper bill, and combinations thereof, between the first coupling element and the first side of the chassis; and a second coupling element coupled to the chassis, the second coupling element configured to retain a second personal effect selected from the group consisting of a personal card, a paper bill, and combinations thereof, between the second coupling element and the second side of the chassis, wherein the second coupling element comprises a stretchable band configured to wrap around the chassis, wherein the first coupling element is configured to overlap the second coupling element about the first side of the chassis, such that the second coupling element enables the money clip to retain the first personal effect selected from the group consisting of a personal card, a paper bill, and combinations thereof, between the first coupling element and the first side of the chassis, via friction.

2. The money clip of claim 1, wherein the first coupling element is mechanically coupled to the second side of the chassis.

3. The money clip of claim 2, wherein the first coupling element extends from the second side of the chassis to the first side of the chassis.

4. The money clip of claim 3, wherein the first coupling element comprises a curved member that extends from the first side of the chassis to the second side of the chassis.

5. The money clip of claim 1, wherein the chassis extends along a first direction and the stretchable band wraps around the chassis along a second direction perpendicular to the first direction, wherein at least a portion of the first coupling element is offset from the chassis along a third direction that is perpendicular to the first direction and the second direction.

6. The money clip of claim 5, wherein the first coupling element is configured to flex along the third direction to thereby couple the first personal effect selected from the group consisting of a personal card, a paper bill, and combinations thereof, against the first side of the chassis.

7. The money clip of claim 5, wherein the stretchable band is configured to flex along the third direction to thereby couple the second personal effect selected from the group consisting of a personal card, a paper bill, and combinations thereof, against the second side of the chassis.

8. The money clip of claim 1, further comprising at least one aperture located on the first coupling element adjacent a top portion of the chassis.

9. The money clip of claim 8, further comprising a bottle opener located on the first coupling element adjacent the top portion of the chassis, the bottle opener defining an angled aperture configured to receive at least a portion of a bottle cap.

10. The money clip of claim 8, wherein the at least one aperture comprises two apertures.

11. The money clip of claim 1, wherein the first coupling element defines a curved shape, the first coupling element configured to withstand repeated bending while retaining the curved shape.

12. The money clip of claim 11, wherein the first coupling element is comprised of a titanium alloy.

13. The money clip of claim 12, wherein the chassis is comprised of aluminum.

14. The money clip of claim 13, wherein a combination of the aluminum and the titanium alloy enables the money clip to block a radio frequency identification (RFID) signal.

15. The money clip of claim 1, wherein the chassis defines a first color.

16. The money clip of claim 15, wherein the first coupling element defines a second color that is different from the first color.

17. The money clip of claim 1, wherein the personal card defines a first width and the money clip defines a second width that is larger than the first width.

18. A money clip, comprising:

a chassis defining a first side and a second side located opposite the first side;

a first coupling element coupled to the chassis, the first coupling element configured to retain a first personal effect selected from the group consisting of a personal card, a paper bill, and combinations thereof, between the first coupling element and the first side of the chassis, wherein the first coupling element comprises four apertures located adjacent the first side of the chassis; and a second coupling element coupled to the chassis, the second coupling element configured to retain a second personal effect selected from the group consisting of a personal card, a paper bill, and combinations thereof, between the second coupling element and the second side of the chassis, wherein the first coupling element is configured to overlap the second coupling element.

19. The money clip of claim 18, wherein the first coupling element is mechanically coupled to the second side of the chassis.

20. The money clip of claim 19, wherein the first coupling element is configured to extend from the second side of the chassis to the first side of the chassis.

* * * * *